US008243107B2

(12) United States Patent
Matsui et al.

(10) Patent No.: US 8,243,107 B2
(45) Date of Patent: Aug. 14, 2012

(54) DISPLAY PANEL DEVICE, DISPLAY DEVICE, AND CONTROL METHOD THEREOF

(75) Inventors: Masafumi Matsui, Kyoto (JP); Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/035,170

(22) Filed: Feb. 25, 2011

(65) Prior Publication Data

US 2011/0148949 A1 Jun. 23, 2011

Related U.S. Application Data

(63) Continuation of application No. PCT/JP2009/006215, filed on Nov. 19, 2009.

(51) Int. Cl.
*G09G 5/10* (2006.01)

(52) U.S. Cl. ..... 345/690; 345/76; 345/77; 345/210; 345/212

(58) Field of Classification Search ..... 345/76–83, 345/87–96, 204–215, 690
See application file for complete search history.

(56) References Cited

U.S. PATENT DOCUMENTS

| | | | | |
|---|---|---|---|---|
| 7,876,314 | B2 * | 1/2011 | Uchino et al. | 345/208 |
| 8,044,894 | B2 * | 10/2011 | Uchino et al. | 345/76 |
| 8,089,429 | B2 * | 1/2012 | Yamashita et al. | 345/76 |
| 2008/0001545 | A1 | 1/2008 | Uchino et al. | |
| 2008/0198111 | A1 | 8/2008 | Yamashita et al. | |
| 2008/0231559 | A1 | 9/2008 | Uchino et al. | |
| 2009/0219235 | A1 | 9/2009 | Yamamoto et al. | |
| 2010/0214273 | A1 | 8/2010 | Shirouzu et al. | |
| 2010/0245331 | A1 | 9/2010 | Shirouzu et al. | |
| 2011/0057966 | A1 | 3/2011 | Ono | |

FOREIGN PATENT DOCUMENTS

| | | |
|---|---|---|
| JP | 2008-009198 | 1/2008 |
| JP | 2008-032866 | 2/2008 |
| JP | 2008-203657 | 9/2008 |
| JP | 2008-233652 | 10/2008 |
| JP | 2008-241783 | 10/2008 |
| JP | 2009-204979 | 9/2009 |

OTHER PUBLICATIONS

An English language translation of JP 2008-032866.
U.S. Appl. No. 13/035,132 to Masafumi Matsui et al., filed Feb. 25, 2011.
U.S. Appl. No. 13/035,175 to Masafumi Matsui et al., filed Feb. 25, 2011.
U.S. Appl. No. 13/082,660 to Shinya Ono, filed Apr. 8, 2011.

* cited by examiner

*Primary Examiner* — Vijay Shankar
(74) *Attorney, Agent, or Firm* — Greenblum & Bernstein, P.L.C.

(57) ABSTRACT

A display panel device includes: a luminescence element; a capacitor; a driver that passes a drain current through the luminescence element; a data line that supplies a signal voltage to the capacitor; a switch that switchably interconnects the data line and the capacitor; and a controller. The controller is configured to: apply a predetermined bias voltage to a second capacitor electrode to prevent a flow of the drain current; turn ON the switch to supply the signal voltage to a first capacitor electrode; apply a reverse bias voltage to the second capacitor electrode to flow a discharge current between a source of the driver and the second capacitor electrode; and turn OFF the switch, after a lapse of a predetermined period of time since the discharge current is caused to flow, to stop the supply of the signal voltage to the first capacitor electrode.

18 Claims, 17 Drawing Sheets

DISPLAY PANEL DEVICE, DISPLAY DEVICE, AND CONTROL METHOD THEREOF

CROSS REFERENCE TO RELATED APPLICATION

This is a continuation application of PCT application No. PCT/JP2009/006215 filed on Nov. 19, 2009, designating the United States of America, the disclosure of which, including the specification, drawings and claims, is incorporated herein by reference in its entirety.

BACKGROUND OF THE INVENTION

1. Field of the Invention

The present invention relates to a display panel device, a display device, and a control method thereof, and particularly to a display panel device and a display device using current-driven luminescence elements, and a control method thereof.

2. Description of the Related Art

As image display devices using current-driven luminescence elements, image display devices using organic electroluminescence (EL) elements are known. The organic EL display devices using the organic EL elements, which are self-luminous, do not need a backlight that is necessary in the case of a liquid crystal display device. For this reason, such organic EL display devices are most suitable for manufacturing thinner devices. Moreover, having no limitation on the viewing angle, the organic EL display devices are expected to become commercially practical as next-generation display devices. In addition, the organic EL elements used in the organic EL display devices are different from liquid crystal cells in that luminance of each luminescence element is controlled according to a value of current applied to the luminescence element. Meanwhile, a liquid crystal cell is controlled according to a voltage applied.

In general, the organic EL display device includes the organic EL elements, which are pixels, arranged in a matrix. A display device referred to as a passive-matrix organic EL display device is explained as follows. An organic EL element is provided at each intersection point of row electrodes (scanning lines) and column electrodes (data lines). Then, a voltage corresponding to a data signal is applied between the electrodes of the selected row and the column electrodes, so that the organic EL elements are driven.

Also, a display device referred to as an active-matrix organic EL display device is explained as follows. A switching thin-film transistor (TFT: Thin Film Transistor) is provided at each intersection point of scanning lines and data lines. A gate of a driver is connected to the switching TFT. Through the selected scanning line, the switching TFT is turned ON and a data signal is fed from a signal line into the driver. By this driver, the organic EL element is driven.

In the case of the passive-matrix organic EL display device, only while the row electrodes (the scanning line) are selected, the organic EL elements connected to these row electrode produce luminescence. Unlike the passive-matrix organic EL display device, the active-matrix organic EL display device allows the organic EL elements to produce luminescence until a next scanning (selection). For this reason, an increase in the number of scanning lines does not result in a decrease in luminance of the display. Thus, the active-matrix organic EL display device can be driven at a low voltage, thereby achieving low power consumption. However, in the case of the active-matrix organic EL display device, due to variations in characteristics of driving transistors, even when the same signal is applied, luminance of the organic EL elements is different for each pixel, thereby causing a problem of variations in luminance.

In order to address this problem, Patent Literature 1 (Patent Literature 1: Japanese Unexamined Patent Application Publication No. 2008-203657), for example, discloses a method of compensating for pixel-to-pixel variations in the characteristics using a simple pixel circuit, as the method of compensating for variations in luminance caused due to the characteristic variations of the driving transistors.

FIG. 14 is a diagram showing a circuit configuration of a pixel unit of a conventional display device disclosed in Patent Literature 1. A display device 500 shown in this diagram includes a pixel array unit 501, a horizontal selector 503, a light scanner 504, and a bias scanner 505. The pixel array unit 501 includes pixel units 502 arranged in a matrix in a plane.

The pixel unit 502 is configured with a simple circuit element which includes: a luminescence element 508 having a cathode that is connected to a negative power line 512; a driving transistor 507 having a drain that is connected to a positive power line 511 and a source that is connected to an anode of the luminescence element 508; a capacitor 509 connected between a gate and the source of the driving transistor 507; an auxiliary capacitor 510 connected between the source of the driving transistor 507 and a bias line BS; and a sampling transistor 506 having a gate that is connected to a scanning line WS, and selectively applying a video signal from a single line SL to the gate of the driving transistor 507.

The light scanner 504 supplies a control signal to the scanning line WS, and the horizontal selector 503 supplies a reference voltage Vref to the signal line SL. With this, a correction operation is performed whereby a voltage corresponding to a threshold voltage Vth of the driving transistor 507 is held in the capacitor 509. Then, following this, a writing operation is performed whereby a signal potential Vsig of the video signal is written to the capacitor 509.

Before the correction operation, the bias scanner 505 changes the potential of the bias line BS, and applies a coupling voltage to the source of the driving transistor 507 via the auxiliary capacitor 510. By doing so, the bias scanner 505 performs a preparatory operation whereby a voltage Vgs between the gate and the source of the driving transistor 507 is initialized to be higher than the threshold voltage Vth.

The pixel unit 502 negatively feeds the drain current of the driving transistor 507 back to the capacitor 509 in the operation of writing the signal voltage Vsig. With this, the signal voltage Vsig is corrected according to the mobility of the driving transistor 507.

FIG. 15 is an operation timing chart of the conventional display device disclosed in Patent Literature 1. This diagram shows an operation performed by the display device per pixel line, and shows that one frame period includes a non-luminescence period and a luminescence period. In the non-luminescence period, the correction operations are performed to correct the threshold voltage Vth and the mobility β of the driving transistor 507.

First, at a time T1 when the present frame period starts, a short control pulse is applied to the scanning line WS and the sampling transistor 506 is thus turned ON temporarily. Since the potential of the signal line SL is the reference voltage Vref at this time, this reference voltage is written to the gate electrode of the driving transistor 507. Then, Vgs of the driving transistor 507 becomes equal to or lower than Vth and, as a result, the driving transistor 507 is cut off. Accordingly, the luminescence element 508 stops producing luminescence and the display device 500 enters the non-luminescence period at the present time T1.

Next, at a time T2, a control signal pulse is applied to the scanning line WS so that the sampling transistor 506 is turned ON.

Immediately after this, at a time T3, the potential of the bias line BS is changed from a high potential to a low potential. As a result, the potential of the driving transistor 507 is lowered via the auxiliary capacitor 510. More specifically, a relationship between Vgs and Vth is expressed as Vgs>Vth, and the driving transistor 507 is thus turned ON. At this time, since the luminescence element 508 is reversely biased, the current does not flow and thus the source potential of the driving transistor 507 increases. Then, when Vgs=Vth, the driving transistor 507 is cut off and the threshold voltage correction operation is completed.

Following this, at a time T4, the potential of the signal line SL changes from the reference voltage Vref to the signal voltage Vsig. At this time, since the sampling transistor 506 is conducting, the gate potential of the driving transistor 507 is Vsig. Here, since the luminescence element 508 is in the cutoff state initially, a discharge current Ids which is the drain current of the driving transistor 507 flows only through the capacitor 509 where the electrical discharge accordingly starts. After this, by a time T5 at which the sampling transistor 506 is turned OFF, the source potential of the driving transistor 507 is increased by ΔV. In this way, the signal potential Vsig is written to the capacitor 509, being added to Vth, and at the same time, the voltage ΔV used for the mobility correction is subtracted from the voltage held in the capacitor 509. This period from the time T4 to the time T5 is a mobility correction period as well as a signal writing period. The higher Vsig, the larger the discharge current Ids and the larger an absolute value of ΔV.

FIG. 16 is a graph showing the characteristics of the discharge current of the capacitor in the mobility correction period. The horizontal axis denotes a lapse of time since the signal voltage Vsig is written, that is, a lapse of time after the time T4. The vertical axis denotes a value of the discharge current. When the gate potential of the driving transistor 507 is changed from the reference voltage Vref to the signal voltage Vsig at the time T4 as described above, the discharge current Ids makes a discharge curve, such as A1, B1, or C1, depending on the magnitude of Vsig. Here, A1 and A2 are discharge curves of the driving transistors in the case where the same magnitude of Vsig is applied to the gates of these driving transistors although these driving transistors have different characteristic parameters of the mobility β. Each of the relationships between B1 and B2 and between C1 and C2 is the same as the above-mentioned relationship between A1 and A2. It can be seen from these discharge curves that, even with the application of the same signal potential, initial values of the discharge current Ids are different when the characteristic parameters of the mobility β are different. However, the discharge currents Ids become almost equivalent to each other with the lapse of discharge time. For example, on comparison between A1 and A2, the discharge currents Ids become almost equivalent at a time a. On comparison between B1 and B2, the discharge currents Ids become almost equivalent at a time b. On comparison between C1 and C2, the discharge currents Ids become almost equivalent at a time c. To be more specific, even when the pixel array 501 includes the driving transistors having different characteristic parameters of the mobility β, the drain current of the driving transistor 507 is caused to be discharged, while the gate bias is applied such that the luminescence element 508 does not produce luminescence in the above-mentioned mobility correction period. Accordingly, the correction can be made, with consideration given to the characteristic variations in the mobility of the driving transistors.

Next, at a time T5, the scanning line WS transitions to a low level side, and the sampling transistor 506 is thus turned OFF. As a result, the gate of the driving transistor 507 is electrically separated from the signal line SL and, at the same time, the drain current of the driving transistor 507 starts flowing through the luminescence element 508. After this, Vgs is maintained constant by the capacitor 509. The value of Vgs here is obtained by correcting the signal voltage Vsig using the threshold voltage Vth and the mobility β.

Lastly, at a time T6, the potential of the bias line BS is restored to the high potential from the low potential so as to allow for a next frame operation.

As described so far, the display device 500 disclosed in Patent Literature 1 prevents the variations in luminance caused due to the variations in the threshold voltage Vth and in the mobility β.

SUMMARY OF THE INVENTION

In the case of the display device 500 disclosed in Patent Literature 1, the setting of an appropriate mobility correction period is important. According to the operation timing chart of the display device 500 shown in FIG. 15, the mobility correction using the discharge current Ids starts at the time T4 at which the voltage of the signal line SL is changed from the reference voltage Vref to the signal voltage Vsig. Then, the mobility correction is completed at the time T5 at which the sampling transistor 506 is turned OFF.

In the case of the display device 500 of Patent Literature 1, however, the mobility correction period varies in the pixel array unit 501 due to a wiring delay of the scanning line WS. The variation in the mobility correction period is explained with reference to FIG. 17, as follows.

FIG. 17 is a diagram for explaining the variation in the mobility correction period in the case of the display device disclosed in Patent Literature 1. As shown in this diagram, in an enlarged view of an area R shown in FIG. 15, the signal potential Vsig of the signal line SL rises at the time T4 at which the mobility correction period starts. Meanwhile, the voltage of the scanning line WS falls at the time T5 at which the mobility correction period ends. Due to the wiring delay of the scanning line WS, a voltage waveform of the scanning line WS at a point P close to the light scanner 504 is a square waveform (indicated by a short dashed line in FIG. 17) reflecting the driving voltage of the light scanner 504. On the other hand, a voltage waveform of the scanning line WS at a point Q away from the light scanner 504 has waveform rounding at the times of rising and falling (indicated by a solid line in FIG. 17) depending on a time constant. The signal voltage Vsig rises at the time T4, and is applied for each of the scanning lines SL arranged for each pixel column. For this reason, the start time of the mobility correction does not vary with the pixel unit because of the wiring delay of the scanning line SL. On the other hand, at the time T5, the voltage between the gate and the source of the sampling transistor 506 reaches the threshold voltage of the sampling transistor 506. For example, at the time T5, a scanning voltage Vws applied to the gate of the sampling transistor 506 decreases to a potential which is the sum of the source potential Vsig of the sampling transistor 506 and the threshold voltage of the sampling transistor 506. Thus, the end times of the mobility correction are different at the points P and Q. The mobility correction period from the time T4 to the time T5 is T0 at the point P as shown in FIG. 17, and is T at the point Q as shown in FIG. 17. A difference between the mobility correction period T0 at the point P and the mobility correction period T at the point Q is ΔT that corresponds to the rounding of the voltage waveform of the scanning line WS at the time of fall. In this way, due to the wiring delay of the scanning line WS, the mobility correction period T does not become a design value T0 of the correction period in actuality, thereby causing the variation among the pixel units.

Also, as described above, the mobility correction ends when the scanning voltage Vws applied to the gate of the sampling transistor 506 decreases to the potential which is the sum of the source potential Vsig of the sampling transistor 506 and the threshold voltage of the sampling transistor 506. On account of this, the mobility correction period T varies depending on the magnitude of the signal voltage Vsig. Hence, there is a problem that when a wiring delay of the scanning line WS exists, the stated variation in the mobility correction period caused due to the changes in the signal voltage Vsig, which is the video signal, is different among the pixel units. To be more specific, the amount of variation in the mobility correction period T is not constant among the pixel units with respect to a change in the shade of gray to be displayed. This may result in the variation in current of a panel surface, causing poor shading.

In view of the stated problem, the present invention has an object to provide a display panel device and a display device which prevent the variation in the mobility correction caused due to a wiring delay from occurring with respect to all writing voltages, and a control method thereof.

In order to achieve the aforementioned object, the display panel device according to an aspect of the present invention is a display panel device including: a luminescence element including a first luminescence electrode and a second luminescence electrode; a first capacitor including a first capacitor electrode and a second capacitor electrode that holds a capacitor voltage; a driver including a driver gate electrode, a driver drain electrode, and a driver source electrode that drives the luminescence element to produce a luminescence by flowing a drain current corresponding to the capacitor voltage through the luminescence element, the driver gate electrode connected to the first capacitor electrode, the driver source electrode connected to the second capacitor electrode; a first power line that determines a potential of the driver drain electrode; a second power line electrically connected to the second luminescence electrode; a data line that supplies a signal voltage to the first capacitor electrode; a first switch that switchably interconnects the data line and the first capacitor electrode; a bias voltage line that supplies, while the signal voltage is supplied to the first capacitor electrode, a predetermined bias voltage to the second capacitor electrode such that a capacitor potential difference between the first capacitor electrode and the second capacitor electrode is at most equal to a driver threshold voltage of the driver; a second capacitor that interconnects the second capacitor electrode and the bias voltage line; and a controller that controls the first switch, a supply of the predetermined bias voltage from the bias voltage line, and a supply of the signal voltage from the data line, wherein the controller is configured to: write the predetermined bias voltage to the second capacitor via the bias voltage line to supply the second capacitor electrode with the predetermined bias voltage such that the capacitor potential difference is at most equal to the driver threshold voltage, even when the signal voltage is supplied to the first capacitor electrode, to prevent a flow of the drain current between the driver source electrode and the second capacitor electrode; supply the signal voltage to the first capacitor electrode when the flow of the drain current between the driver source electrode and the second capacitor electrode is prevented and the first switch is in an ON state; write a reverse bias voltage corresponding to the predetermined bias voltage to the second capacitor via the bias voltage line to cause the flow of the drain current between the driver source electrode and the second capacitor electrode when the signal voltage is supplied to the first capacitor electrode; and turn OFF the first switch after an elapse of a predetermined period of time after causing the flow of the drain current between the driver source electrode and the second capacitor electrode to stop the supply of the signal voltage to the first capacitor electrode, whereby an electrical charge accumulated in the first capacitor is discharged during the predetermined period when the flow of the drain current between the driver source electrode and the second capacitor electrode is caused.

With the display panel device, the display device, and the control method thereof in the present invention, the influence due to the wiring delay can be reduced by causing the variation, which is caused in the mobility correction period corresponding to the shade of gray to be displayed, to occur in the start time of the mobility correction as well. Accordingly, the variation in the mobility correction can be reduced with respect to all shades of gray.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENTS

Figure 1:
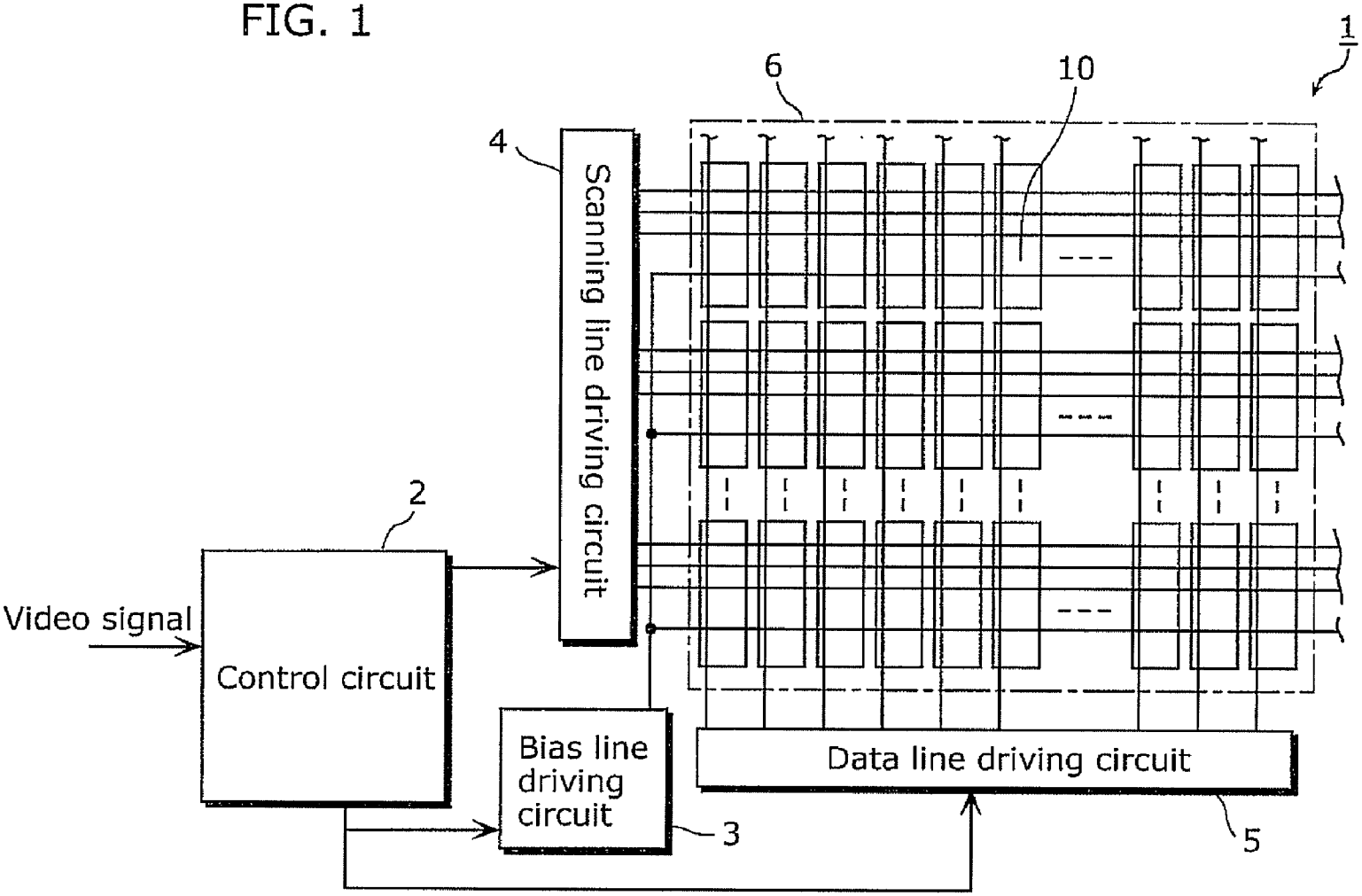
FIG. 1 is a block diagram showing an electrical configuration of a display panel device of the present invention.

A display panel device according to an implementation of the present invention includes: a luminescence element including a first luminescence electrode and a second luminescence electrode; a first capacitor including a first capacitor electrode and a second capacitor electrode that holds a capacitor voltage; a driver including a driver gate electrode, a driver drain electrode, and a driver source electrode that drives the luminescence element to produce a luminescence by flowing a drain current corresponding to the capacitor voltage through the luminescence element, the driver gate electrode connected to the first capacitor electrode, the driver source electrode connected to the second capacitor electrode; a first power line that determines a potential of the driver drain electrode; a second power line electrically connected to the second luminescence electrode; a data line that supplies a signal voltage to the first capacitor electrode; a first switch that switchably interconnects the data line and the first capacitor electrode; a bias voltage line that supplies, while the signal voltage is supplied to the first capacitor electrode, a predetermined bias voltage to the second capacitor electrode such that a capacitor potential difference between the first capacitor electrode and the second capacitor electrode is at most equal to a driver threshold voltage of the driver; a second capacitor that interconnects the second capacitor electrode and the bias voltage line; and a controller that controls the first switch, a supply of the predetermined bias voltage from the bias voltage line, and a supply of the signal voltage from the data line, wherein the controller is configured to: write the predetermined bias voltage to the second capacitor via the bias voltage line to supply the second capacitor electrode with the predetermined bias voltage such that the capacitor potential difference is at most equal to the driver threshold voltage, even when the signal voltage is supplied to the first capacitor electrode, to prevent a flow of the drain current between the driver source electrode and the second capacitor electrode; supply the signal voltage to the first capacitor electrode when the flow of the drain current between the driver source electrode and the second capacitor electrode is prevented and the first switch is in an ON state; write a reverse bias voltage corresponding to the predetermined bias voltage to the second capacitor via the bias voltage line to cause the flow of the drain current between the driver source electrode and the second capacitor electrode when the signal voltage is supplied to the first capacitor electrode; and turn OFF the first switch after an elapse of a predetermined period of time after causing the flow of the drain current between the driver source electrode and the second capacitor electrode to stop the supply of the signal voltage to the first capacitor electrode, whereby an electrical charge accumulated in the first capacitor is discharged during the predetermined period when the flow of the drain current between the driver source electrode and the second capacitor electrode is caused.

According to the implementation of the present invention, when the reverse bias corresponding to the predetermined bias voltage is written to the second capacitor via the bias voltage line, the discharge current which is the drain current of the driver flows between the source electrode of the driver and the second capacitor electrode of the first capacitor. Using the discharge current, the mobility correction for the driver is started.

After the lapse of the predetermined period of time since the discharge current starts flowing between the source electrode of the driver and the second capacitor electrode of the first capacitor, the first switch is controlled so that the supply of the signal voltage to the first capacitor electrode of the first capacitor is stopped. Then, the mobility correction of the driver using the discharge current thereof is terminated.

Thus, the start of the mobility correction of the driver using the discharge current is controlled by the writing of the reverse bias voltage to the second capacitor. This control is separated from the control of the supply of the signal voltage to the first capacitor. Meanwhile, the end of the mobility correction of the driver using the discharge current is controlled by the stopping of the supply of the signal voltage to the first capacitor. That is, the control performed in the start the mobility correction of the driver using the discharge current and the control performed in the end of the mobility correction of the driver using the discharge current are respectively performed through the different controls. On account of this, the amount of lag in the start of the mobility correction offsets the amount of lag in the end of the mobility correction. The lag in the start is caused between the time when the controller provides the reverse bias voltage and the time when the discharge current starts flowing. The lag in the end is caused between the time when the controller provides a scanning signal in order to turn OFF the first switch and the time when the discharge current stops flowing. Accordingly, the mobility correction period can be controlled with accuracy, as compared with the conventional case where the conventional mobility correction period includes the amount of delay only in the end time of the mobility correction. As a result of this, the mobility of the driver can be controlled with accuracy.

In the display panel device according to the implementation of the present invention, when the reverse bias voltage corresponding to the predetermined bias voltage is written to the second capacitor via the bias voltage line, a voltage is written to the second capacitor in accordance with a first gradual change from the predetermined bias voltage to the reverse bias voltage.

An increase in the screen size of the display panel device means increases in the wiring resistance and in the parasitic capacity because many pixel units are connected to the wiring. When the discharge current is caused to flow between the source electrode of the driver and the second capacitor electrode of the first capacitor through the writing of the reverse bias voltage to the second capacitor, the voltage of the bias voltage line steeply changes in the pixel unit located, for example, in a marginal area of the display panel device that is close to the controller. On account of this, when the discharge current starts flowing, the bias voltage line has already reached almost the reverse bias voltage. On the other hand, in the pixel unit located, for example, in a central area of the display panel device that is away from the controller, a delay is caused in the control over the bias voltage line. For this reason, as compared with the case of the marginal area of the display panel, the voltage of the bias voltage line changes gently according to the predetermined time constant. Therefore, after the discharge current starts flowing, there would be a time lag before the voltage of the bias voltage line reaches the bias voltage between the marginal area and the central area of the display panel. Due to the variations in the time taken for the bias voltage line to reach the reverse bias voltage after the start of the conduction between the source electrode of the driver and the second capacitor electrode of the first capacitor, a difference is caused in the transient response of the bias voltage between the marginal area and the central area of the display panel. As a result, the different durations of time during which the discharge current flows cause the different amounts of electrical discharge. This results in the variations in luminescence between the marginal area and the central area of the display panel. It should be noted here that the pixel unit located in the central area of the display panel device is an example of a pixel unit located in an area of the display panel device that is farthest from the controller. In the pixel unit located in the area of the display panel device that is farthest from the controller, the wiring resistance and the parasitic capacity increase. Hence, when the pixel circuit is arranged in one of the marginal areas of the display panel, the same problem as described takes place in the pixel unit located in the marginal area on the other side of the display panel device.

According to the implementation of the present invention, when the reverse bias voltage is written to the second capacitor via the bias voltage line, the voltage is gradually changed from the predetermined bias voltage to the reverse bias voltage.

As a result, the times taken for the voltage of the bias voltage line to reach the reverse bias voltage can be made as uniform as possible between, for example, the marginal area and the central area of the display panel device. To be more specific, by making the transient response characteristics of the bias voltages as uniform as possible, the amounts of discharge can be made equivalent. With this, the variations in luminescence between, for example, the marginal area and the central area of the display panel device can be prevented. Also, unevenness in the amount of luminescence between, for example, the marginal area and the central area of the display panel device can be prevented. It should be noted here that the pixel unit located in the central area of the display panel device is an example of a pixel unit located in an area of the display panel device that is farthest from the controller. In the case where the pixel circuit is arranged in one of the marginal areas of the display panel device, unevenness in the amount of luminescence taking place between the pixel units arranged in the present marginal area and the other marginal area of the display panel device can be prevented.

In the display panel device according to the implementation of the present invention, the display panel device further includes: a scanning line that switchably interconnects the data line and the first capacitor electrode with the first switch by supplying a scanning signal voltage to a first switch gate electrode of the first switch, wherein, when the first switch is in an OFF state after the elapse of the predetermined period of time, the controller supplies the scanning signal voltage from the scanning line to the first switch, the scanning signal voltage being supplied in accordance with a second gradual change.

According to the implementation, regarding the end times of the mobility correction, the times taken before the scanning line causes the first switch to be turned OFF can be made uniform between, for example, the marginal area and the central area of the display panel device. To be more specific, by making the transient response characteristics of the scanning signal voltage as uniform as possible, the amounts of discharge can be made equivalent. As a result, the amount of delay in the start time and the amount of delay in the end time correspond to each other more precisely, and thus cancel each other out.

In the display panel device according to the implementation of the present invention, a degree of the first gradual change from the predetermined bias voltage to the reverse bias voltage is equal to a degree of the second gradual change in the scanning signal voltage that is supplied to the first switch.

According to the implementation, the degree of the gradual change in the bias voltage to reduce the variation in the start time of the mobility correction is caused to agree with the degree of the gradual change in the scanning signal voltage to reduce the variation in the end time of the mobility correction. As a result, the amount of delay in the start time and the amount of delay in the end time correspond to each other with high accuracy, and thus cancel each other out.

In the display panel device according to the implementation of the present invention, the luminescence element includes a luminescent layer sandwiched between the first luminescence electrode and the second luminescence electrode, at least the luminescence element, the first capacitor, the driver, and the second capacitor compose a pixel, the display device includes a plurality of pixels that includes the pixel, and the first gradual change from the predetermined bias voltage to the reverse bias voltage corresponds to a change in an amount of the reverse bias voltage written to the second capacitor, over a period of time from a writing start to a writing end, in one of the plurality of pixels that is located in an area of the display panel device that is farthest from the controller.

According to the implementation, the gradual change in the voltage from the predetermined bias voltage to the reverse bias voltage corresponds to the change in the amount of the reverse bias voltage written to the second capacitor, over a period of time from the writing start to the writing end, in the pixel circuit located in an area of the display panel device that is farthest from the controller.

With reference to the timing to start the discharge current flow in the central area of the display panel device, the timing to start the discharge current flow is determined for a different area of the display panel device. Thus, the variations in luminescence between the marginal area and the central area of the display panel device can be prevented. Also, unevenness in the amount of luminescence between, for example, the marginal area and the central area of the display panel device can be prevented. It should be noted here that the pixel unit located in the central area of the display panel device is an example of a pixel unit located in an area of the display panel device that is farthest from the controller. In the case where the pixel circuit is arranged in one of the marginal areas of the display panel device, unevenness in the amount of luminescence taking place between the pixel units arranged in the present marginal area and the other marginal area of the display panel device can be prevented.

In the display panel device according to the implementation of the present invention, the display panel device further includes a scanning line that switchably interconnects the data line and the first capacitor electrode with the first switch by supplying a scanning signal voltage to a first switch gate electrode of the first switch, wherein a second gradual change in the scanning signal voltage supplied to the first switch gate electrode corresponds to a change in a voltage of the first switch gate electrode in the one the plurality of pixels that is located in the area of the display panel device that is farthest from the controller, the second gradual change being caused by the controller when the controller turns OFF the first switch after the elapse of the predetermined period of time.

According to the implementation, regarding the end time of the mobility correction, with reference to the timing to end the discharge current flow in the central area of the display panel device, for example, the timing to end the discharge current flow is determined for a different area of the display panel device. As a result, the amount of delay in the start and the amount of delay in the end correspond to each other with high accuracy, and thus cancel each other out.

In the display panel device according to the implementation of the present invention, the display panel device further includes: a third power line that supplies a reference voltage to the second capacitor electrode; and a second switch that switchably interconnects the second capacitor electrode and the third power line, wherein the reference voltage causes the capacitor potential difference to be greater than the driver threshold voltage, and the controller is further configured to: turn ON the second switch to supply the reference voltage to the second capacitor electrode; turn ON the first switch to supply a fixed voltage to fix a voltage of the first capacitor electrode; supply, after the potential difference in the first capacitor reaches the driver threshold voltage and the driver is in an OFF state, the predetermined bias voltage via the bias voltage line to prevent the flow of the drain current between the driver source electrode and the second capacitor electrode while the driver is in the OFF state; and turn ON the first switch when the flow of the drain current between the driver source electrode and the second capacitor electrode is prevented, and supply the signal voltage to the first capacitor electrode According to the implementation, the second switch is controlled so that the reference voltage is supplied to the second capacitor electrode of the first capacitor, and the first switch is controlled so that the fixed voltage to fix the voltage of the first capacitor electrode of the first capacitor is supplied. Then, a period of time taken for the potential difference between the first and second capacitor electrodes of the first capacitor to reach the threshold voltage of the driver is to be waited. More specifically, the first capacitor is caused to hold the threshold voltage of the driver.

In this state, the predetermined bias voltage is supplied via the bias voltage line, so that the drain current is not caused to flow between the source electrode of the driver and the second capacitor electrode of the first capacitor. Then, in this state, the signal voltage starts to be supplied to the first capacitor electrode of the first capacitor. Hence, the first capacitor accumulates the amount of electrical charge corresponding to the signal voltage for which the threshold voltage of the driving voltage has been compensated.

In this way, the first capacitor holds the threshold voltage of the driver and, then, the signal voltage is supplied to the first capacitor electrode of the first capacitor. On account of this, a desired potential difference can be accumulated in the first capacitor. In other words, since the driver is not turned ON before the writing of the signal voltage to the first capacitor is completed, the desired potential difference can be accumulated in the first capacitor.

As a result, the current corresponding to the desired potential difference is caused to flow between the first power line and the second power line in the luminescence period. Thus, the amount of luminescence of the luminescence element can be controlled with accuracy.

In the display panel device according to the implementation of the present invention, a voltage value of the predetermined bias voltage is preset such that, after the capacitor potential difference reaches the driver threshold voltage and the driver is in the OFF state, a luminescence potential difference between the first luminescence electrode and the second luminescence electrode is less than a luminescence threshold voltage of the luminescence element, the luminescence element producing the luminescence at the luminescence threshold voltage.

According to the implementation, the value of the predetermined bias voltage is set such that, while the signal voltage is being supplied to the first capacitor electrode of the first capacitor, the potential difference between the first luminescence electrode of the luminescence element and the second luminescence electrode of the luminescence element becomes lower than the threshold voltage of the luminescence element at which the luminescence element starts producing luminescence. In other words, the predetermined bias voltage fulfills a function of preventing the driver from turning ON before the writing of the signal voltage to the first capacitor is completed. Also, the predetermined bias voltage fulfills another function of preventing a leakage current from flowing from the second capacitor electrode of the first capacitor through the second power line via the luminescence element before the writing of the signal voltage to the first capacitor is completed. On account of this, the variation in the potential difference of the first capacitor caused while the signal voltage is being written to the first capacitor can be prevented. Thus, the desired potential difference can be held in the first capacitor. As a result, the current corresponding to the desired potential difference is caused to flow between the first power line and the second power line in the luminescence period. Therefore, the amount of luminescence of the luminescence element can be controlled with accuracy.

In the display panel device according to the implementation of the present invention, the third power line is a scanning line, and the scanning line is configured to switchably interconnect the data line and the first capacitor electrode with the first switch by supplying a scanning signal voltage to a first switch gate electrode of the first switch, and the reference voltage is a voltage of the scanning line that that turns OFF the first switch to disconnect the data line and the first capacitor electrode.

According to the implementation, as a preliminary step of detecting the threshold voltage of the driver, the voltage of the scanning line which controls the first switch is used as the reference voltage to be applied to the second capacitor electrode of the first capacitor. At this time, the reference voltage causes a potential difference larger than the threshold voltage of the driver to the first capacitor, using the fixed voltage supplied from the data line. Here, as the reference voltage, the voltage of the scanning line that is supplied when the first switch is turned OFF is used. As a consequence, the drain current corresponding to the desired potential difference is caused to flow between the first power line and the second power line. Accordingly, the amount of luminescence of the luminescence element can be controlled with accuracy. At the same time, the pixel circuit can be simplified.

In the display panel device according to the implementation of the present invention, the display panel device further includes a second switch that switchably interconnects the first luminescence electrode and the driver source electrode, wherein the controller is configured to turn OFF the second switch to disconnect the first luminescence electrode and the driver source electrode during the predetermined period of time The reverse bias voltage corresponding to the predetermined bias voltage is written to the second capacitor via the bias voltage line, while the first switch is controlled so that the signal voltage is supplied to the first capacitor electrode of the first capacitor. Then, the mobility correction is performed using the discharge current in a period from when the discharge current is caused to flow between the source electrode of the driver and the second capacitor electrode of the first capacitor to when the first switch is controlled so that the supply of the signal voltage to the first capacitor electrode of the first capacitor is stopped.

Meanwhile, suppose here that the reverse bias voltage corresponding to the predetermined bias voltage is written to the second capacitor via the bias voltage line, while the first switch is controlled so that the signal voltage is applied to the first capacitor electrode of the first capacitor. Then, also suppose here that the current flows through the luminescence element which thus produces luminescence before the completion of the mobility correction of the driver. In such a case, the desired potential difference to be obtained as a result of the mobility correction cannot be accumulated in the first capacitor. For this reason, the variations in luminescence among the pixels caused by the luminescence elements cannot be corrected with accuracy.

According to the implementation, non-conduction is caused between the first luminescence electrode of the luminescence element and the source electrode of the driver in the aforementioned period. With this, even when the signal voltage is supplied to the first capacitor electrode of the first capacitor, the drain current does not flow through the luminescence element because there is no conduction between the first luminescence electrode of the luminescence element and the source electrode of the driver.

The reverse bias voltage corresponding to the predetermined bias voltage is written to the second capacitor via the bias voltage line, while the first switch is controlled so that the signal voltage is supplied to the first capacitor electrode of the first capacitor. Thus, the current is prevented from flowing through the luminescence element. This can prevent the luminescence element from producing luminescence before the completion of the mobility correction of the driver. As a consequence, the variations in luminescence among the pixels caused by the luminescence elements can be corrected with accuracy.

In the display panel device according to the implementation of the present invention, the display panel device further includes a second switch that switchably interconnects the first luminescence electrode and the driver source electrode, wherein, when the predetermined bias voltage is written to the second capacitor via the bias voltage line and the signal voltage is supplied to the first capacitor electrode, the controller is configured to turn OFF the second switch to disconnect the first luminescence electrode and the driver source electrode.

While the signal voltage is being supplied to the first capacitor electrode of the first capacitor, there may be a case where, depending on the potential of the first capacitor electrode of the second capacitor, the current flows from the first capacitor electrode of the second capacitor to the luminescence element. In such a case, there would be a problem as a result that the threshold voltage of the driver that is set in the first capacitor may vary when the signal voltage is written to the first capacitor.

According to the implementation, while the predetermined bias voltage is being written to the second capacitor via the bias voltage line and the signal voltage is being supplied to the first capacitor electrode of the first capacitor, the second switch is controlled so that the drain current does not flow between the first luminescence electrode of the luminescence element and the source electrode of the driver. With this, the current can be prevented from flowing from the first capacitor electrode of the second capacitor to the luminescence element while the signal voltage is being supplied to the first capacitor electrode. Thus, the threshold voltage set in the first capacitor can be prevented from varying. Consequently, the first capacitor precisely accumulates the electrical charge corresponding to the signal voltage for which the threshold voltage of the driving voltage has been compensated. Then, the current corresponding to the desired potential difference is caused to flow between the first power line and the second power line. Accordingly, the amount of luminescence of the luminescence element can be controlled with accuracy.

In the display panel device according to the implementation of the present invention, the bias voltage line further supplies a second reverse bias voltage to the second capacitor to cause the capacitor potential difference to be greater than the driver threshold voltage, and the controller is further configured to: write the second reverse bias voltage to the second capacitor while the first switch is in the ON state and supply a fixed voltage to the first capacitor to fix a voltage of the first capacitor to cause the capacitor potential difference to be greater than the driver threshold voltage to cause the flow of the drain current between the driver source electrode and the second capacitor electrode; stop the flow of the drain current between the driver source electrode and the second capacitor electrode, after the capacitor potential difference reaches the driver threshold voltage to turn OFF the driver; and turn ON the first switch to supply the signal voltage to the first capacitor electrode when the flow of the drain current between the driver source electrode and the second capacitor electrode is prevented while the driver is in an OFF state.

According to the implementation, the second reverse bias voltage is written to the second capacitor while the first switch is controlled so that the fixed voltage to fix the voltage of the first capacitor electrode of the first capacitor is supplied. The second reverse bias voltage is a voltage that causes the potential difference larger than the threshold voltage of the driver to the first capacitor. Then, a period of time taken for the potential difference between the first capacitor electrode and the second capacitor electrode of the first capacitor to reach the threshold voltage of the driver is to be waited. Accordingly, the first capacitor is caused to hold the threshold voltage of the driver.

When the threshold voltage of the driver is held in the first capacitor, the drain current of the driver stops flowing. In this state, the supply of the signal voltage to the first capacitor electrode of the first capacitor is started. Hence, the first capacitor accumulates the amount of electrical charge corresponding to the signal voltage for which the threshold voltage of the driving voltage has been compensated.

In this way, the first capacitor holds the threshold voltage of the driver and, then, the signal voltage is supplied to the first capacitor electrode of the first capacitor. On account of this, a desired potential difference can be accumulated in the first capacitor. As a result, the current corresponding to the desired potential difference is caused to flow between the first power line and the second power line in the luminescence period. Thus, the amount of luminescence of the luminescence element can be controlled with accuracy.

In the display panel device according to the implementation of the present invention, the display panel device further includes a second switch that switchably interconnects the first luminescence electrode and the driver source electrode, wherein the controller is further configured to turn OFF the second switch to disconnect the first luminescence electrode and the driver source electrode during a period of time from when the second reverse bias voltage is supplied to the second capacitor to when the capacitor potential difference reaches the driver threshold voltage to turn OFF the driver.

The second reverse bias voltage is supplied to the second capacitor so that the threshold voltage of the driver is held in the first capacitor. Here, the value of the second reverse bias voltage to be applied to the second capacitor is influenced by the amount accumulated in the luminescence element in addition to the amount in the first capacitor.

In this case, the value of the voltage to be applied to the first capacitor electrode of the second capacitor is influenced by the amount accumulated in the luminescence element, and is smaller than the desired voltage value. On this account, an extra application of the second reverse bias voltage is necessary in order to apply the desired voltage to the first capacitor electrode of the second capacitor, thereby leading to a problem of higher power consumption.

According to the implementation, non-conduction is caused between the first luminescence electrode of the luminescence element and the source electrode of the driver for the period of time. The period lasts from when the supply of the second reverse bias voltage to the second capacitor is started to when the potential difference between the first capacitor electrode and the second capacitor electrode of the first capacitor reaches the threshold voltage of the driver. With this, while the threshold voltage is set to the driver, the value of the voltage to be applied to the first capacitor electrode of the second capacitor is prevented from being influenced by the amount in the luminescence element. Hence, the voltage to be applied to the first capacitor electrode of the second capacitor can be set at a desired value. Consequently, the extra application of the second reverse bias voltage is unnecessary, and low power consumption can be achieved.

In the display panel device according to the implementation of the present invention, after the electrical charge accumulated in the first capacitor is discharged during the predetermined period of time, the controller is configured to turn ON the second switch to interconnect the first luminescence electrode and the driver source electrode to flow the drain current, corresponding to the capacitor potential difference, between the first power line and the second power line.

According to the implementation, after the electrical charge accumulated in the first capacitor is discharged in the aforementioned period, the supply of the signal voltage to the first capacitor electrode of the first capacitor is stopped so that conduction is caused between the first luminescence electrode of the luminescence element and the source electrode of the driver. Thus, the current corresponding to the potential difference accumulated in the first capacitor flows between the first power line and the second power line. As a result, the current corresponding to the desired potential difference is caused to flow between the first power line and the second power line. Therefore, the amount of luminescence of the luminescence element can be controlled with accuracy.

A display device according to an implementation of the present invention is a display device including: the display panel device according to the above implementation of the present invention; and a power source that supplies power to the first power line and the second power line, wherein the luminescence element further includes a luminescent layer sandwiched between the first luminescence electrode and the second luminescence electrode, and the luminescence element is included in a matrix in which at least a plurality of the luminescence element is are arranged.

A display device according to an implementation of the present invention is a display device including: the display panel device according to the above implementation of the present invention; and a power source that supplies power to the first power line and the second power line, wherein the luminescence element further includes a luminescent layer sandwiched between the first luminescence electrode and the second luminescence electrode, the luminescence element, the first capacitor, the driver, the first switch, and the second switch compose a pixel, and the pixel is included in a matrix in which a plurality of pixels that included the pixel is arranged.

In the display device according to the implementation of the present invention, the luminescence element is an organic electroluminescence element.

A method of controlling the display device according to an implementation of the present invention is a method of controlling a display device, wherein the display device includes: a luminescence element including a first luminescence electrode and a second luminescence electrode; a first capacitor including a first capacitor electrode and a second capacitor electrode that holds a capacitor voltage; a driver including a driver gate electrode, a driver drain electrode, and a driver source electrode that drives the luminescence element to produce a luminescence by flowing a drain current corresponding to the capacitor voltage through the luminescence element, the driver gate electrode connected to the first capacitor electrode, the driver source electrode connected to the second capacitor electrode; a first power line that determines a potential of the driver drain electrode; a second power line electrically connected to the second luminescence electrode; a data line that supplies a signal voltage to the first capacitor electrode; a first switch that switchably interconnects the data line and the first capacitor electrode; a bias voltage line that supplies, while the signal voltage is supplied to the first capacitor electrode, a predetermined bias voltage to the second capacitor electrode such that a capacitor potential difference between the first capacitor electrode and the second capacitor electrode is at most equal to a driver threshold voltage of the driver; and a second capacitor that interconnects the second capacitor electrode and the bias voltage line, and the control method comprising: writing the predetermined bias voltage to the second capacitor via the bias voltage line to supply the second capacitor electrode with the voltage such that the capacitor potential difference is at most equal to the driver threshold voltage, even when the signal voltage is supplied to the first capacitor electrode, to prevent a flow of the drain current between the driver source electrode and the second capacitor electrode; supplying the signal voltage to the first capacitor electrode when the flow of the drain current between the driver source electrode and the second capacitor electrode is prevented and when the first switch is in an ON state; writing a reverse bias voltage corresponding to the predetermined bias voltage to the second capacitor via the bias voltage line to cause the flow of the drain current between the driver source electrode and the second capacitor electrode when the signal voltage is supplied to the first capacitor electrode; and turning OFF the first switch after an elapse of a predetermined period of time after causing the flow of the drain current between the driver source electrode and the second capacitor electrode to stop the supply of the signal voltage to the first capacitor electrode, whereby an electrical charge accumulated in the first capacitor is discharged during the predetermined period when the flow of the drain current between the driver source electrode and the second capacitor electrode is caused.

The following is a description of the preferred embodiments of the present invention, with reference to the drawings. It should be noted that the components having the same or equivalent functions in the drawings are indicated by the same reference numerals, and that the explanation thereof is not repeated.

First Embodiment

A display panel device in the present embodiment includes: an organic EL element; a first capacitor; a driving transistor which passes a drain current corresponding to a voltage held by the first capacitor through the organic EL element; a data line for supplying a signal voltage; a selection transistor which switches between conduction and non-conduction between the data line and a first capacitor electrode of the first capacitor; a bias voltage line for supplying a predetermined bias voltage or a reverse bias voltage to a second capacitor electrode of the first capacitor; a second capacitor which is provided between the second capacitor electrode of the first capacitor and the bias voltage line; a second switch which provides a timing at which a reference voltage is to be applied to the second capacitor electrode of the first capacitor; and a controller.

The controller; (1) writes the predetermined bias voltage to the second capacitor via the bias voltage line so as not to cause the drain current of the driving transistor to flow; (2) turns ON a first switch so that the signal voltage is supplied to the first capacitor electrode of the first capacitor; (3) writes the reverse bias voltage to the second capacitor via the bias voltage line so as to cause the discharge current to flow between the source electrode of the driving transistor and the second capacitor electrode of the first capacitor; and (4) turns OFF the first switch, after a lapse of a predetermined period of time since the discharge current starts to flow, so that the supply of the signal voltage to the first capacitor electrode of the first capacitor is stopped and that the electrical charge accumulated in the first capacitor is caused to be discharged because of the discharge current in the aforementioned period.

Thus, the amount of lag in the start of the mobility correction corresponds to the amount of lag in the end of the mobility correction. The lag in the start is caused between when the reverse bias voltage starts being supplied and when the discharge current starts flowing. The lag in the end is caused between when the controller provides a scanning signal to the first switch and when the discharge current stops flowing. Accordingly, the mobility correction period can be controlled with accuracy. As a consequence of this, the mobility of the driver can be controlled with accuracy.

The following is a description of the first embodiment of the present invention, with reference to the drawings.

FIG. 1 is a block diagram showing an electrical configuration of a display panel device of the present invention. A display panel device 1 shown in this diagram includes a control circuit 2, a bias line driving circuit 3, a scanning line driving circuit 4, a data line driving circuit 5, and a display unit 6. In the display unit 6, a plurality of luminescence pixels 10 are arranged in a matrix.

Figure 2:
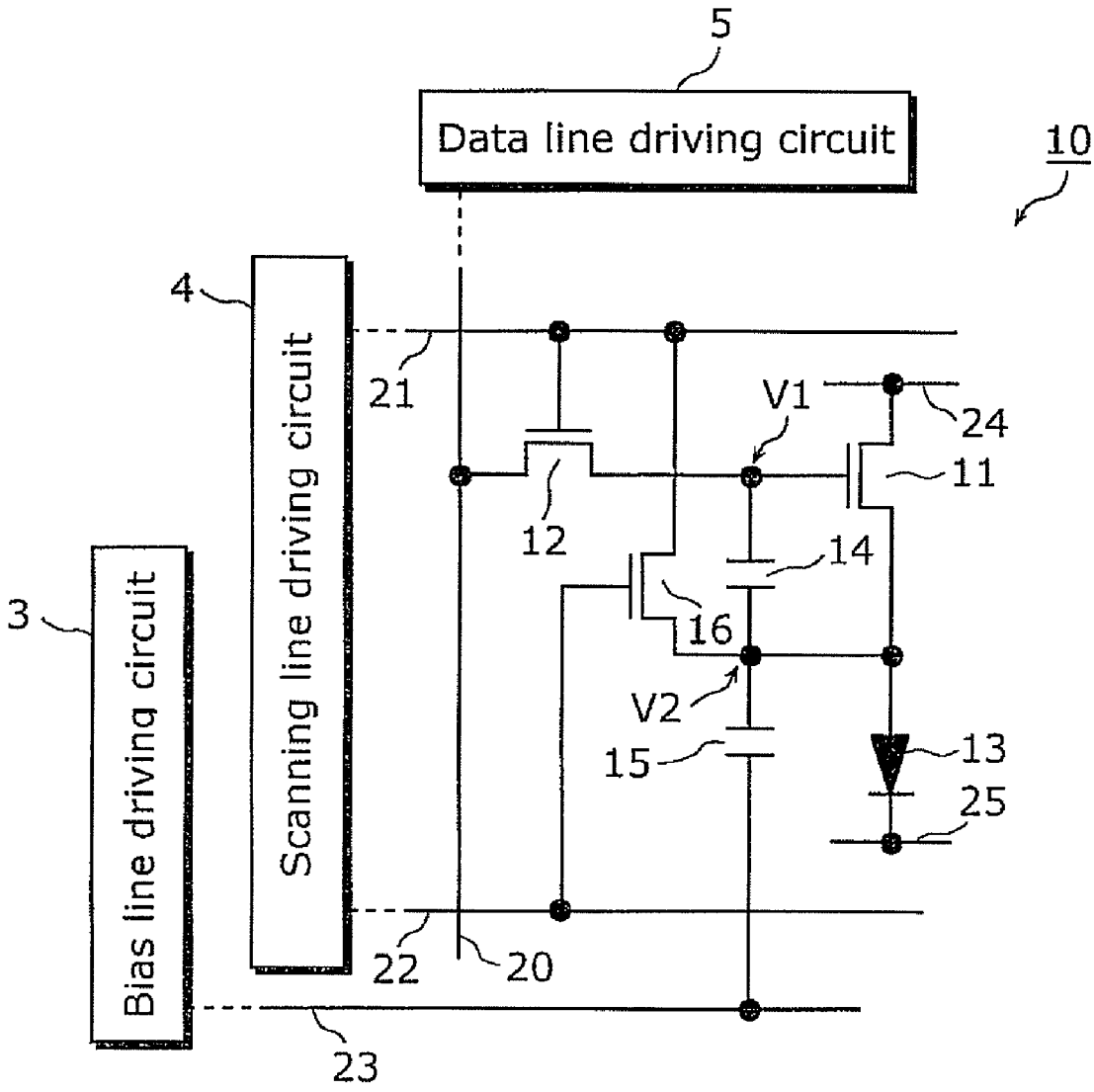
FIG. 2 is a diagram showing a configuration of a luminescence pixel circuit included in a display unit and connections between the luminescence pixel circuit and peripheral circuits thereof in a first embodiment of the present invention.

FIG. 2 is a diagram showing a configuration of a luminescence pixel circuit included in the display unit and connections between the luminescence pixel circuit and peripheral circuits thereof in the first embodiment of the present invention. The luminescence pixel 10 includes a driving transistor 11, a selection transistor 12, an organic EL element 13, capacitors 14 and 15, a switching transistor 16, a data line 20, scanning lines 21 and 22, a bias line 23, a positive power line 24, and a negative power line 25. As the peripheral circuits, a bias line driving circuit 3, a scanning line driving circuit 4, and a data line driving circuit 5 are provided.

Connection relationships and functions of the components shown in FIGS. 1 and 2 are explained as follows.

The control circuit 2 has a function of controlling the bias line driving circuit 3, the scanning line driving circuit 4, and the data line driving circuit 5. The control circuit 2 converts a video signal received from an external source into a voltage signal based on correction data or the like, and then provides the voltage signal to the data line driving circuit 5.

The scanning line driving circuit 4 is a driving circuit which is connected to the scanning lines 21 and 22, and which has a function of switching between conduction and non-conduction between the selection transistor 12 and the switching transistor 16 included in the luminescence pixel 10 by providing a scanning signal to the scanning lines 21 and 22. After a lapse of a predetermined period of time since the discharge current is caused to flow between a source electrode of the driving transistor 11 and a second capacitor electrode of the capacitor 14, the scanning line driving circuit 4 controls the selection transistor 12 so that the supply of the signal voltage to a first capacitor electrode of the capacitor 14 is stopped. Accordingly, the mobility correction of the driver using the discharge current is terminated.

The data line driving circuit 5 is a controller which is connected to the data line 20, and which has a function of providing the signal voltage based on the video signal to the luminescence pixel 10.

The bias line driving circuit 3 is a controller which is connected to the bias line 23, and which has a function of applying a predetermined bias voltage or a reverse bias voltage corresponding to the predetermined bias voltage to the capacitor 15. The bias line driving circuit 3 writes the reverse bias voltage to the capacitor 15 via the bias line 23. By doing so, the bias line driving circuit 3 passes a discharge current, that is a drain current, between the source electrode of the driving transistor 11 and the second capacitor electrode of the capacitor 14. In this way, the bias line driving circuit 3 causes the mobility correction of the driver using the discharge current to be started.

The display unit 6 includes the plurality of luminescence pixels 10, and displays an image based on the video signal received by the display panel device from the external source.

It is preferable that the bias line driving circuit 3 and the scanning line driving circuit 4 should be arranged on the same side with respect to the display unit 6.

Moreover, the bias line driving circuit 3 and the scanning line driving circuit 4 do not need to exist in isolation from each other, and may be configured as a single driving circuit having the combined functions of both the bias line driving circuit 3 and the scanning line driving circuit 4.

The driving transistor 11 is a driver which includes: a gate electrode connected to a source electrode of the selection transistor 12; a drain electrode connected to the positive power line 24 that is a first power line; and the source electrode connected to an anode electrode of the organic EL element 13 and to the second capacitor electrode of the capacitor 14. The driving transistor 11 converts a voltage applied between the gate electrode and the source electrode into a drain current corresponding to the voltage, and supplies this drain current, as a signal current, to the organic EL element 13. Or, the driving transistor 11 supplies this drain current, as a discharge current, to the second capacitor electrode of the capacitor 14. The driving transistor 11 is configured with an n-type thin-film transistor (n-TFT), for example.

The selection transistor 12 is the first switch that includes: a gate electrode connected to the scanning line 21; a drain electrode connected to the data line 20; and the source electrode connected to the first capacitor electrode of the capacitor 14. The selection transistor 12 has a function of determining a timing at which the signal voltage and a fixed voltage of the data line 20 is to be applied to the first capacitor electrode of the capacitor 14.

The organic EL element 13 is a luminescence element which includes a cathode electrode connected to the negative power line 25 that is a second power line. The organic EL element 13 produces luminescence according to the aforementioned signal current flowing from the driving transistor 11.

The capacitor 14 is a first capacitor that includes: the first capacitor electrode connected to the gate electrode of the driving transistor 11; and the second capacitor electrode connected to the source electrode of the driving transistor 11. The capacitor 14 hold a voltage corresponding to the signal voltage or the fixed voltage supplied from the data line 20. For example, the capacitor 14 has a function of stably holding the voltage between the gate and the source of the driving transistor 11 and thus stabilizing the drain current supplied from the driving transistor 11 to the organic EL element 13 after the selection transistor 12 is turned OFF. The capacitor 14 also has a function of holding the threshold voltage of the driving transistor 11 using the fixed voltage supplied from the data line 20. Thus, the signal voltage supplied thereafter from the data line 20 is corrected according to the threshold voltage. Moreover, using the discharge current flowing through the second capacitor electrode of the capacitor 14 via the source electrode of the driving transistor 11, the mobility correction is performed on the signal voltage which has been supplied from the data line 20 and on which the correction using the threshold voltage has been performed. The capacitor 14 has a function of holding the signal voltage which has been supplied from the data line 20 and on which the threshold voltage correction and the mobility correction have been performed.

The capacitor 15 is a second capacitor that is connected between the second capacitor electrode of the capacitor 14 and the bias line 23. The capacitor 15 has a function of causing the potential of the second capacitor electrode of the capacitor 14 and the potential of the source electrode of the driving transistor 11 to be determined according to the voltage applied from the bias line 23.

The switching transistor 16 is the second switch that is connected between the second capacitor electrode of the capacitor 14 and the scanning line 21. The switching transistor 16 has a function of determining a timing at which a reference voltage VgL, which is a scanning signal voltage of the scanning line 21 at LOW level, is to be applied to the second capacitor electrode of the capacitor 14. The switching transistor 16 also has a function of causing the source potential of the driving transistor 11 to be determined according to the application of the reference voltage VgL to the second capacitor electrode of the capacitor 14. Even when the voltage applied from the data line 20 is a fixed voltage Vreset that is not a signal voltage, the reference voltage VgL is previously applied from the scanning line 21 via the switching transistor 16. Thus, this function of the switching transistor 16 allows a potential difference larger than the threshold voltage of the driving transistor 11 to be caused to the capacitor 14 during the threshold voltage correction period.

The reference voltage VgL is preset to the second capacitor electrode of the capacitor 14. Then, the fixed voltage Vreset is preset so that the node voltage between the source electrode of the driving transistor 11 and the first luminescence electrode of the organic EL element 13 is lower than the threshold voltage of the organic EL element 13 during a threshold voltage detection period. This threshold voltage detection period lasts for a predetermined period of time after the fixed voltage Vreset is supplied to the first capacitor electrode of the capacitor 14. Therefore, the drain current of the driving transistor 11 does not flow through the organic EL element 13 in this predetermined period. On this account, before a luminescence period in which the organic EL element 13 produces luminescence, a period of time for correcting the threshold voltage of the driving transistor 11 can be provided.

The data line 20 is connected to the data line driving circuit 5 and to each luminescence pixel that belongs to a pixel column including the luminescence pixels 10, and has a function of supplying a signal voltage Vdata and the fixed voltage Vreset which determine luminescence intensity.

The display pane device 1 further includes as many data lines 20 as the number of pixel columns.

The scanning line 21 is connected to the scanning line driving circuit 4 and to each luminescence pixel that belongs to a pixel row including the luminescence pixels 10. The scanning line 21 has a function of providing a timing at which the signal voltage is to be written to each luminescence pixel that belongs to the pixel row including the luminescence pixels 10. Also, the scanning line 21 has a function of providing a timing at which the fixed voltage Vreset is to be applied to the gate of the driving transistor 11 included in the luminescence pixel. The scanning line 21 is also connected to the second capacitor electrode of the capacitor 14 via the switching transistor 16. Thus, the scanning line 21 has a function of applying the reference voltage VgL, which is the scanning signal voltage, to the second capacitor electrode of the capacitor 14 by causing the switching transistor 16 to turn ON.

The scanning line 22 is connected to the scanning line driving circuit 4, and has a function of providing a timing at which the reference voltage VgL is to be applied to the potential of the second capacitor electrode of the capacitor 14. The reference voltage VgL here is the scanning signal voltage of the scanning line 21 at LOW level.

The bias line 23 is a bias voltage line which is connected to the bias line driving circuit 3 and which has a function of applying the voltage supplied from the bias line driving circuit 3 to the second capacitor electrode of the capacitor 14 via the capacitor 15.

The display panel device 1 further includes as many scanning lines 21, scanning lines 22, and bias lines 23 as the number of pixel rows.

It should be noted that each of the positive power line 24 that is the first power line and the negative power line 25 that is the second power line is also connected to the other luminescence pixels and to a voltage source.

Note that each of the display panel device 1 of the present embodiment and a display device including the above-mentioned voltage source is one aspect according to the embodiment of the present invention.

Figure 3:
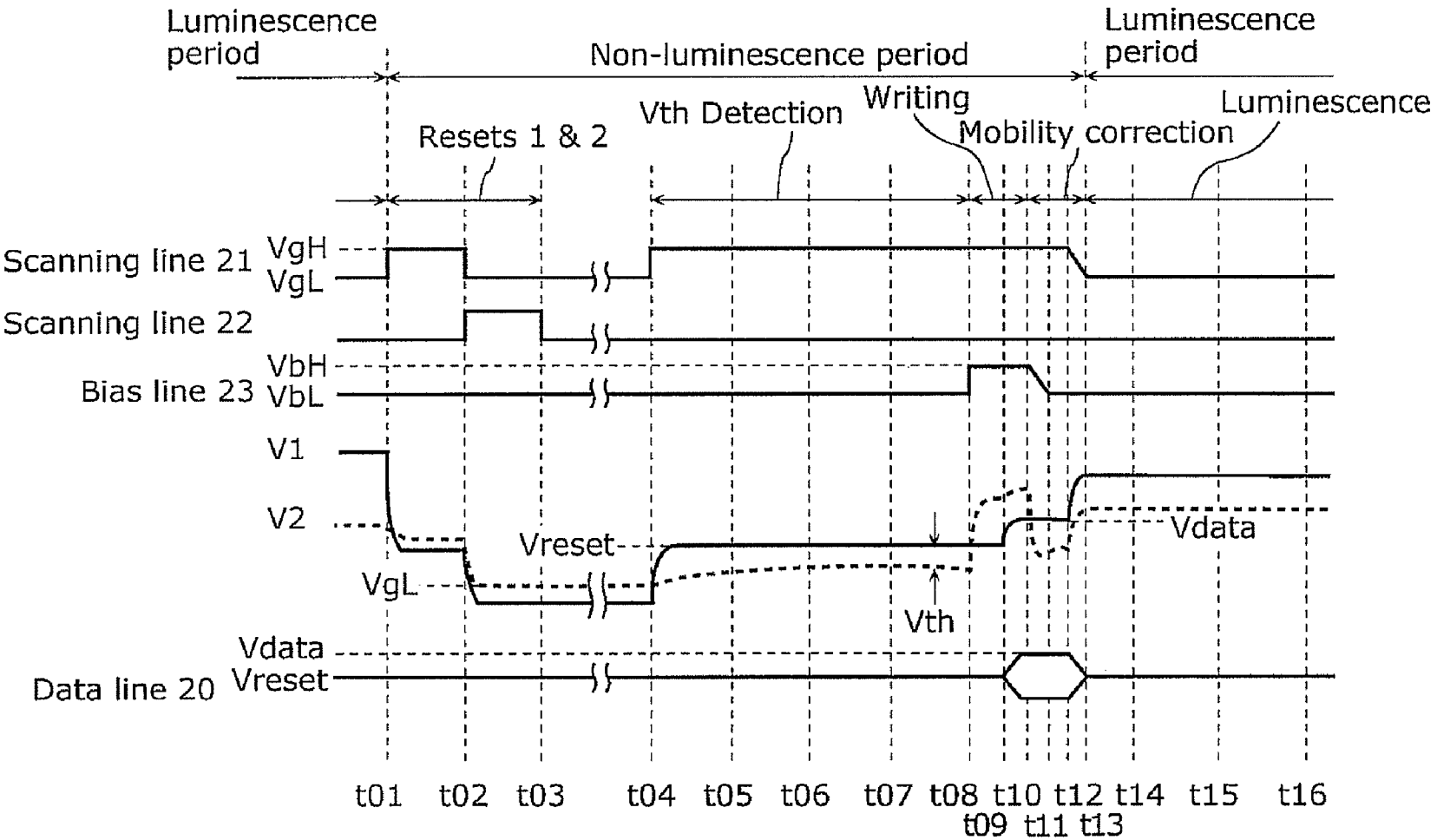
FIG. 3 is an operation timing chart of a control method for the display panel device in the first embodiment of the present invention.
Figure 4:
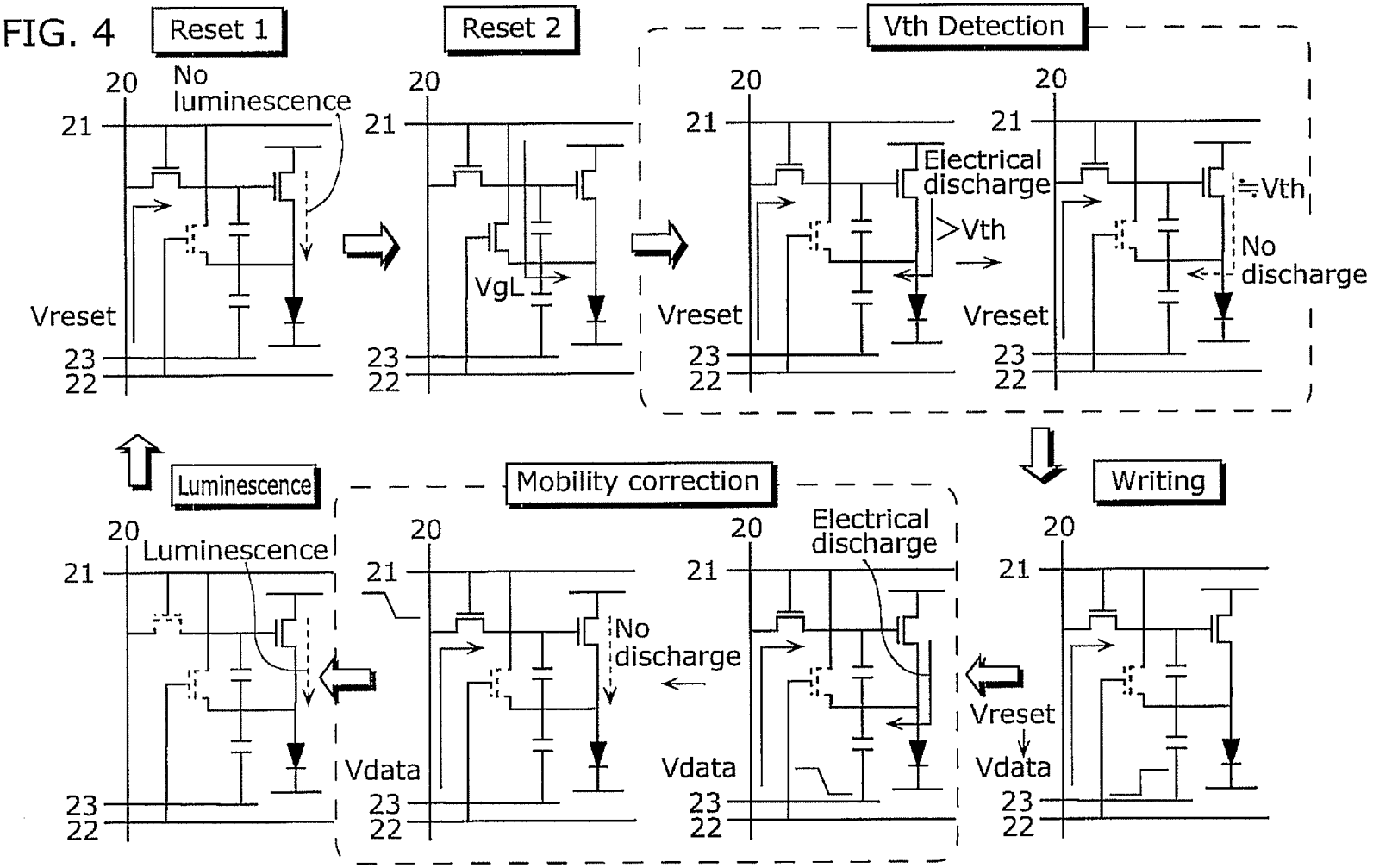
FIG. 4 is a state transition diagram of the pixel circuit included in the display panel device in the first embodiment of the present invention.

Next, the control method of the display device of the present embodiment is explained, with reference to FIGS. 3 and 4.

FIG. 3 is an operation timing chart of the control method of the display device in the first embodiment of the present invention. In this diagram, the horizontal axis denotes time. In the vertical direction, the respective waveform charts of the voltages generated in the scanning line 21, the scanning line 22, the bias line 23, a potential V1 of the first capacitor electrode of the capacitor 14, a potential V2 of the second capacitor electrode of the capacitor 14, and the data line 20 are shown in this order from the top. This diagram shows an operation performed by the display device per pixel line, and shows that one frame period includes a non-luminescence period and a luminescence period. In the non-luminescence period, the correction operations to correct a threshold voltage Vth and a mobility β of the driving transistor 11 are performed.

FIG. 4 is a state transition diagram of the pixel circuit included in the display device in the first embodiment of the present invention.

First, at a time t01, the scanning line driving circuit 4 causes the voltage level of the scanning line 21 to change from LOW to HIGH, so that the selection transistor 12 is turned ON. As a result, the fixed voltage Vreset is applied to the gate electrode (V1) of the driving transistor 11 via the data line 20. At this time, the switching transistor 16 is in the OFF state. Here, the luminescence period of a previous frame accordingly ends. In a period from the time t01 to a time t02, luminescence is not produced. This state corresponds to a state of Reset 1 shown in FIG. 4.

Next, at the time t02, the scanning line driving circuit 4 causes the voltage level of the scanning line 21 to change from HIGH to LOW, so that the selection transistor 12 is turned OFF. At the same time, the scanning line driving circuit 4 causes the voltage level of the scanning line 22 to change from LOW to HIGH, and applies the reference voltage VgL to the second capacitor electrode of the capacitor 14 via the switching transistor 16. The reference voltage VgL here is the scanning signal of the scanning line 21 at LOW level. The reference voltage VgL is preset such that the voltage between the anode and the cathode of the organic EL element 13 is lower than the threshold voltage of the organic EL element 13. As a preliminary step of detecting the threshold voltage Vth of the driving transistor 11, the voltage VgL of the scanning line 21 which causes the selection transistor 12 to be turned OFF is used as the reference voltage to be applied to the second capacitor electrode of the capacitor 14. Therefore, the pixel circuit can be simplified.

Next, at a time 03, the scanning line driving circuit 4 causes the voltage level of the scanning line 22 to change from HIGH to LOW, and thus stops the application of the reference voltage VgL to the second capacitor electrode of the capacitor 14. In a period from the time t02 to the time t03, the reference voltage VgL is applied to the second capacitor electrode of the capacitor 14 and the source electrode of the driving transistor 11. This state corresponds to a state of Reset 2 shown in FIG. 4.

Next, at a time t04, the scanning line driving circuit 4 causes the voltage level of the scanning line 21 to change from LOW to HIGH, and thus applies the fixed voltage Vreset to the first capacitor electrode (V1) of the capacitor 14 via the data line 20. At this time, because of the fixed voltage Vreset applied to the first capacitor electrode of the capacitor 14 and the reference voltage VgL having been applied to the second capacitor electrode of the capacitor 14 in the period from the time t02 to the time t03, a potential difference larger than the threshold voltage Vth of the driving transistor 11 is caused to the capacitor 14. Accordingly, the driving transistor 11 is turned ON, and the drain current of the driving transistor 11 flows through a current path from the positive power line 24 to the source electrode of the driving transistor 11 and to the second capacitor electrode of the capacitor 14. In the period from the time t04 to a time t08, the above-mentioned drain current flows. With the passage of time, when the voltage held by the capacitor 14 becomes Vth, the drain current stops flowing. As a result, an electrical charge corresponding to the threshold voltage Vth is accumulated in the capacitor 14. At the end of this period, the source electrode of the driving transistor 11 is expressed as Vreset−Vth, because of the drain current. However, since the fixed voltage Vreset is preset so as to be lower than the threshold voltage of the organic EL element 13, the drain current does not flow through the organic EL element 13. The period from the time t04 to the time t08 corresponds to a state of Vth Detection shown in FIG. 4

Next, at the time t08, the bias line driving circuit 3 causes the voltage level of the bias line 23 to change from a reverse bias voltage VbL to a predetermined bias voltage VbH. Here, the predetermined bias voltage VbH is set such that, even when the signal voltage Vdata is to be supplied to the first capacitor electrode of the capacitor 14 at a time t09, the potential of the first capacitor electrode with respect to the second capacitor electrode of the capacitor 14 becomes equal to or lower than the threshold voltage Vth. For this reason, the drain current does not flow between the source electrode of the driving transistor 11 and the second capacitor electrode of the capacitor 14. Moreover, the predetermined bias voltage VbH is set such that the voltage between the anode and the cathode of the organic EL element 13 becomes equal to or lower than the threshold voltage of the organic EL element 13. This can prevent a leakage current from flowing from the second capacitor electrode of the capacitor 14 to the negative power line 25 at the time t08.

Next, at the time t09, the data line driving circuit 5 supplies the signal voltage Vdata to the first capacitor electrode of the capacitor 14 in the state where the drain current does not flow between the source electrode of the driving transistor 11 and the second capacitor electrode of the capacitor 14 and where the selection transistor 12 is turned ON. Here, as described above, the potential of the first capacitor electrode with respect to the second capacitor electrode of the capacitor 14, that is expressed as V1−V2, is equal to or lower than the threshold voltage Vth. Hence, at the time t09, the drain current still does not flow between the source electrode of the driving transistor 11 and the second capacitor electrode of the capacitor 14. The period from the time t08 to a time t10 corresponds to a state of Writing shown in FIG. 4.

Following this, between the time t10 and a time t11, the bias line driving circuit 3 causes the voltage level of the bias line 23 to gradually change from the predetermined bias voltage VbH to the reverse bias voltage VbL. Here, this state of the gradual change in voltage of the bias line 23 refers to a state where the voltage of the bias line 23 is provided while being gradually changed over the period of time from the time t10 to the time W. As a result of this, for example, the predetermined bias voltage VbH at the time t10 becomes the reverse bias voltage VbL at the time t11 which is subsequent to the time t10. In other words, this is not the same as in the case, for example, where the scanning line driving circuit 4 causes the scanning signal voltage to change from the LOW-level voltage VgL to the HIGH-level voltage VgH at the moment of the time t04. To be more specific, the bias line driving circuit 3 here does not cause the voltage to instantaneously change from the predetermined bias voltage VbH to the reverse bias voltage VbL at the moment of the time t10.

It should be noted that, in the present embodiment, by spending a transition period of time corresponding to a time constant of the bias line 23 in the luminescence pixel that is located in an area farthest from the bias line driving circuit 3, the bias line driving circuit 3 causes the voltage to linearly change from the predetermined bias voltage VbH to the reverse bias voltage VbL. To be more specific, the gradual change in voltage from the predetermined bias voltage VbH to the reverse bias voltage VbL corresponds to a change in the amount of the reverse bias voltage VbL written to the capacitor 15 from the writing start to the writing end in the luminescence pixel that is located in the area farthest from the bias line driving circuit 3.

Accordingly, with reference to the timing to start the discharge current flow in the central area of the display panel device, the timing to start the discharge current flow is determined for a different area of the display panel device. Thus, the variations in luminescence between the marginal area and the central area of the display panel device can be prevented. Also, unevenness in the amount of luminescence between, for example, the marginal area and the central area of the display panel device can be prevented. It should be noted here that the luminescence pixel located in the central area of the display panel device is an example of a luminescence pixel arranged in an area of the display panel device that is farthest from the bias line driving circuit 3. In the case where the bias line driving circuit 3 is arranged in one of the marginal areas of the display panel device, unevenness in the amount of luminescence taking place between the luminescence pixels arranged in the present marginal area and the other marginal area of the display panel device can be prevented.

The above-described gradual change in the bias voltage provided by the bias line driving circuit 3 is implemented by, for instance, a bias voltage waveform formation unit arranged inside the bias line driving circuit 3. For example, the bias line driving circuit 3 includes a first signal path and a second single path. To the first signal path, the bias voltage is provided via the bias voltage waveform formation unit. To the second signal path, the bias voltage is provided without involving the bias voltage waveform formation unit. These signal paths are selectable, using a switch. For example, in order to instantaneously change the voltage from the reverse bias voltage VbL to the predetermined bias voltage VbH at the time t08 in FIG. 3, the second signal path is selected to cause the bias voltage to be provided. On the other hand, in order to gradually change the voltage from the predetermined bias voltage VbH to the reverse bias voltage VbL over the predetermined period of time between the time t10 and the time t11 in FIG. 3, the first signal path is selected to cause the bias voltage to be provided. In the present embodiment, the bias voltage is formed in a ramp waveform from the time t10 to the time t11 in FIG. 3 and, for this reason, a ramp waveform generation circuit is built in the bias voltage waveform formation unit.

Also, it is possible to cause a gradient to the bias voltage waveform by setting an internal impedance of the bias voltage waveform formation unit at a finite value.

During this period from the time t10 to the time t11, because the signal voltage Vdata is kept applied via the selection transistor 12, the potential V1 of the first capacitor electrode of the capacitor 14 continues to hold Vdata. On the other hand, in accordance with to the gradual fall in the voltage of the bias line 23, the potential V2 of the second capacitor electrode of the capacitor 14 gradually falls. During the period from the time t10 to the time t11, because of the time difference between V1 and V2, there is a time $t_{st}$ at which the potential of the first capacitor electrode with respect to the second capacitor electrode of the capacitor 14, that is expressed as V1−V2, becomes equal to or higher than Vth. At this time $t_{st}$, the discharge current, that is the drain current of the driving transistor 11, starts flowing between the source electrode of the driving transistor 11 and the second capacitor electrode of the capacitor 14. Thus, the time $t_{st}$ becomes a start time of the mobility correction of the driving transistor 11.

Next, from a time t12 to a time t13, the scanning line driving circuit 4 causes the voltage level of the scanning line 21 to gradually change from VgH, which is a second voltage, to VgL, which is a first voltage. Here, this state of the gradual change in voltage of the scanning line 21 refers to a state where the voltage of the scanning line 21 is provided while being gradually changed over the period from the time t12 to the time t13. As a result of this, for example, the HIGH-level VgH at the time t12 becomes the LOW-level VgL at the time t13 which is subsequent to the time t12. In other words, this is not the same as in the case, for example, where the scanning line driving circuit 4 causes the scanning signal voltage to change from the LOW-level voltage VgL to the HIGH-level voltage VgH at the moment of the time t04. To be more specific, the scanning line driving circuit 4 does not cause the voltage to instantaneously change from the HIGH-level VgH to the LOW-level VgL at the moment of the time t12.

It should be noted that, in the present embodiment, by spending a transition period of time corresponding to a change in the scanning signal voltage having the time constant of the scanning line 21 in the luminescence pixel that is located in an area farthest from the scanning line driving circuit 4, the scanning line driving circuit 4 causes the scanning signal voltage to linearly change from VgH to VgL. To be more specific, the gradual change in the scanning signal voltage from VgH to VgL corresponds to a change in the voltage applied to the gate electrode of the selection transistor 12 in the luminescence pixel that is located in the area farthest from the scanning line driving circuit 4.

Accordingly, with reference to the timing to end the discharge current flow in the central area of the display panel device, the timing to end the discharge current flow is determined for a different area of the display panel device. Thus, the variations in luminescence between the marginal area and the central area of the display panel device can be prevented. Also, unevenness in the amount of luminescence between, for example, the marginal area and the central area of the display panel device can be prevented. It should be noted here that the luminescence pixel located in the central area of the display panel device is an example of a luminescence pixel arranged in an area of the display panel device that is farthest from the scanning line driving circuit 4. In the case where the scanning line driving circuit 4 is arranged in one of the marginal areas of the display panel device, unevenness in the amount of luminescence taking place between the luminescence pixels arranged in the present marginal area and the other marginal area of the display panel device can be prevented.

Also, regarding the start time of the mobility correction, with reference to the timing to start the discharge current flow in the central area of the display panel device, for example, the timing to start the discharge current flow is determined for other areas of the display panel device. On account of this, the amount of delay in the start and the amount of delay in the end correspond to each other with greater accuracy and, thus cancel each other out.

In order to implement the above-described gradual change in the scanning signal voltage provided by the scanning line driving circuit 4, the scanning line driving circuit 4 may include the same component as the one that is described above in the case where the gradual change is caused to the output waveform of the bias voltage provided by the bias line driving circuit 3.

From the time t12 to the time t13, the potential V1 which is the source electrode potential of the selection transistor 12 is the signal voltage Vdata. As the voltage of the gate electrode of the selection transistor 12 gradually changes from VgH to VgL, the voltage between the gate and the source of the selection transistor 12 becomes the threshold voltage of the selection transistor 12 at a time $t_{end}$. Then, the selection transistor 12 turns OFF. At the time $t_{end}$, the gate electrode of the driving transistor 11 is electrically separated from the data line 20, and the voltage on which the threshold value correction and the β correction have been performed is held between the gate electrode and the source electrode of the driving transistor 11. Accordingly, the time $t_{end}$ is the end time of the mobility correction of the driving transistor 11.

Unlike the conventional case, the time $t_{st}$ at which the discharge current starts flowing is not the time when the signal voltage Vdata is applied to the gate electrode of the driving transistor. The time $t_{st}$ is determined according to the reverse bias voltage applied from the bias line driving circuit 3 to the luminescence pixel via the bias line 23. On account of this, the time $t_{st}$, that is the start time of the mobility correction, has the amount of delay in the start time depending on the location of the luminescence pixel with respect to the bias line driving circuit 3. On the other hand, the time $t_{end}$ at which the discharge current stops flowing is determined, as in the conventional case, according to the scanning signal voltage applied from the scanning line driving circuit 4 to the luminescence pixel via the scanning line 21. On account of this, the time $t_{end}$, that is the end time of the mobility correction, has the amount of delay in the end time depending on the location of the luminescence pixel with respect to the scanning line driving circuit 4.

As described so far, in the case of the conventional display device, the delay is caused only in the end time of the mobility correction, according to the time constant of the scanning line. This results in the variation in the mobility correction period. Meanwhile, in the case of the display device according to the present embodiment of the present invention, the delay is caused in the start time of the mobility correction according to the time constant of the bias line 23, and the delay is caused in the end time of the mobility correction according to the time constant of the scanning line 21. Hence, the amount of delay in the start time and the amount of delay in the variation in the mobility correction period depending on the distance from the driving circuit can be reduced. As a consequence, the mobility of the driving transistor 11 can be corrected with accuracy. The state of the period from the time t10 to the time t13 corresponds to a state of Mobility correction shown in FIG. 4.

Moreover, in the present embodiment, when the reverse bias voltage is written to the capacitor 15 via the bias line 23, the voltage is caused to gradually change from the predetermined bias voltage to the reverse bias voltage.

Thus, the time periods taken for the voltages written to the capacitors 15 respectively included in the luminescence pixels to reach the reverse bias voltages can be made uniform between, for example, the marginal area and the central area. With this, the transient responses of the discharge current can be made uniform and thus the amounts of discharge current can be made equivalent. As a result, the variations in luminescence between, for example, the marginal area and the central area of the display panel device can be prevented. Also, the unevenness in the amount of luminescence between, for example, the marginal area and the central area of the display panel device can be prevented. According to the gradual change caused in the voltage of the bias line 23 by the bias line driving circuit 3, the start time of the mobility correction is determined. Also, according to the gradual change caused in the voltage of the scanning line 21 by the scanning line driving circuit 4, the end time of the mobility correction is determined. The reason why the mobility correction period can be corrected with accuracy through these determinations is explained later with reference to FIG. 5.

Lastly, at the time t13, the voltage level of the scanning line 21 becomes the reverse bias voltage VgL. Also, from the time $t_{end}$, the drain current corresponding to the voltage, that is expressed as V1−V2, flows through the organic EL element 13. Then, the organic EL element 13 accordingly starts producing luminescence. At this time, the voltage expressed as V1−V2 held in the capacitor 14 is the voltage which is obtained by correcting the signal voltage Vdata using the threshold voltage Vth and the mobility β.

Next, the explanation is given for the reason why the mobility correction period can be controlled with accuracy in the display panel device and the display device of the present invention, according to the first embodiment of the present invention.

As described earlier with reference to FIG. 17, in the case of the mobility correction period using the conventional method, the mobility correction period starts when the voltage of the data line changes from the fixed voltage Vref to the signal voltage Vsig, with the sampling transistor 506 being previously turned ON. Then, the signal voltage Vsig starts being applied to the gate electrode of the driving transistor. Meanwhile, the mobility correction period ends when the selection transistor is switched from the ON state to the OFF state after the predetermined electrical discharge.

Figure 14:
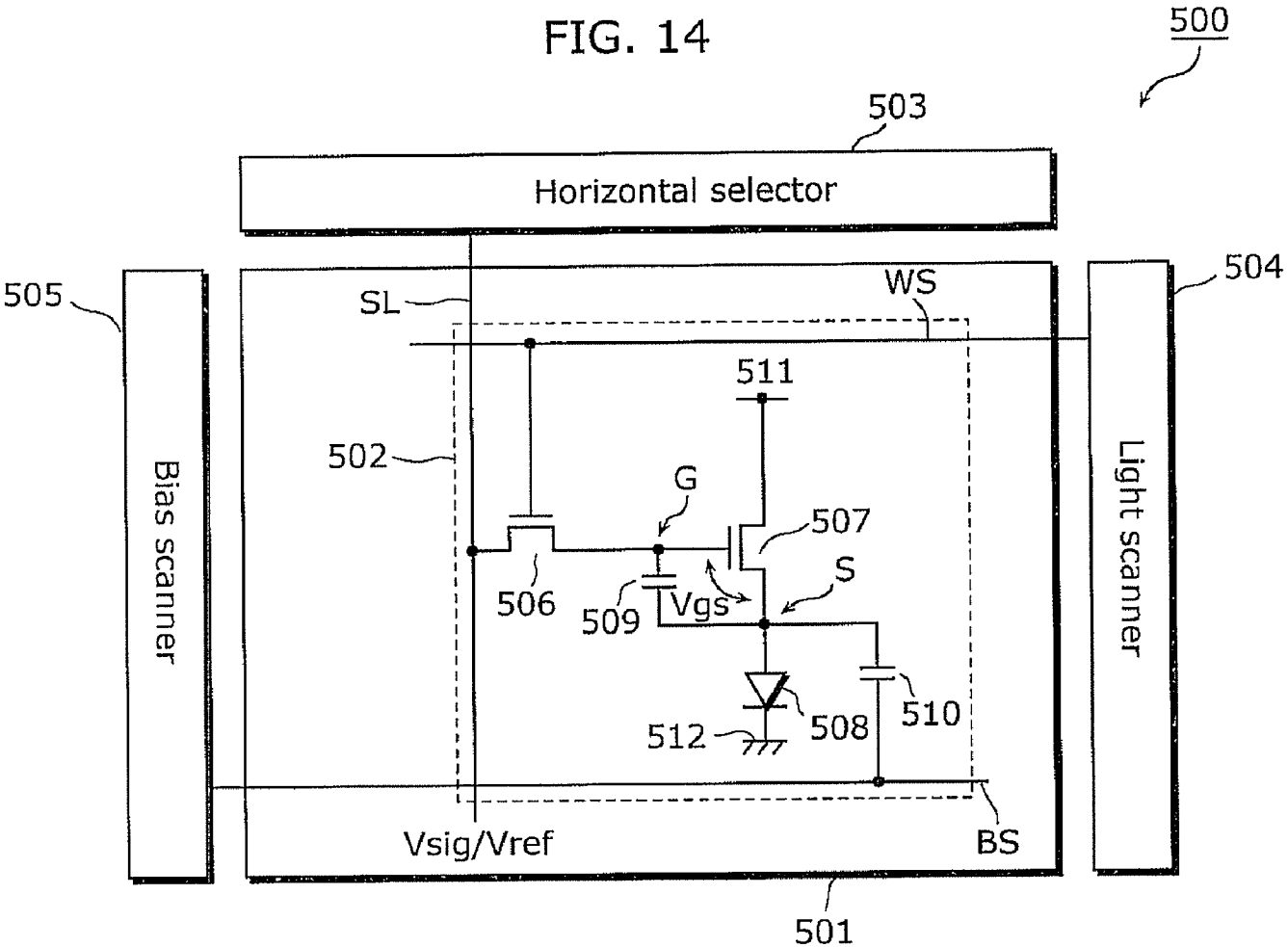
FIG. 14 is a diagram showing a circuit configuration of a pixel unit of a conventional display device disclosed in Patent Literature 1.
Figure 17:
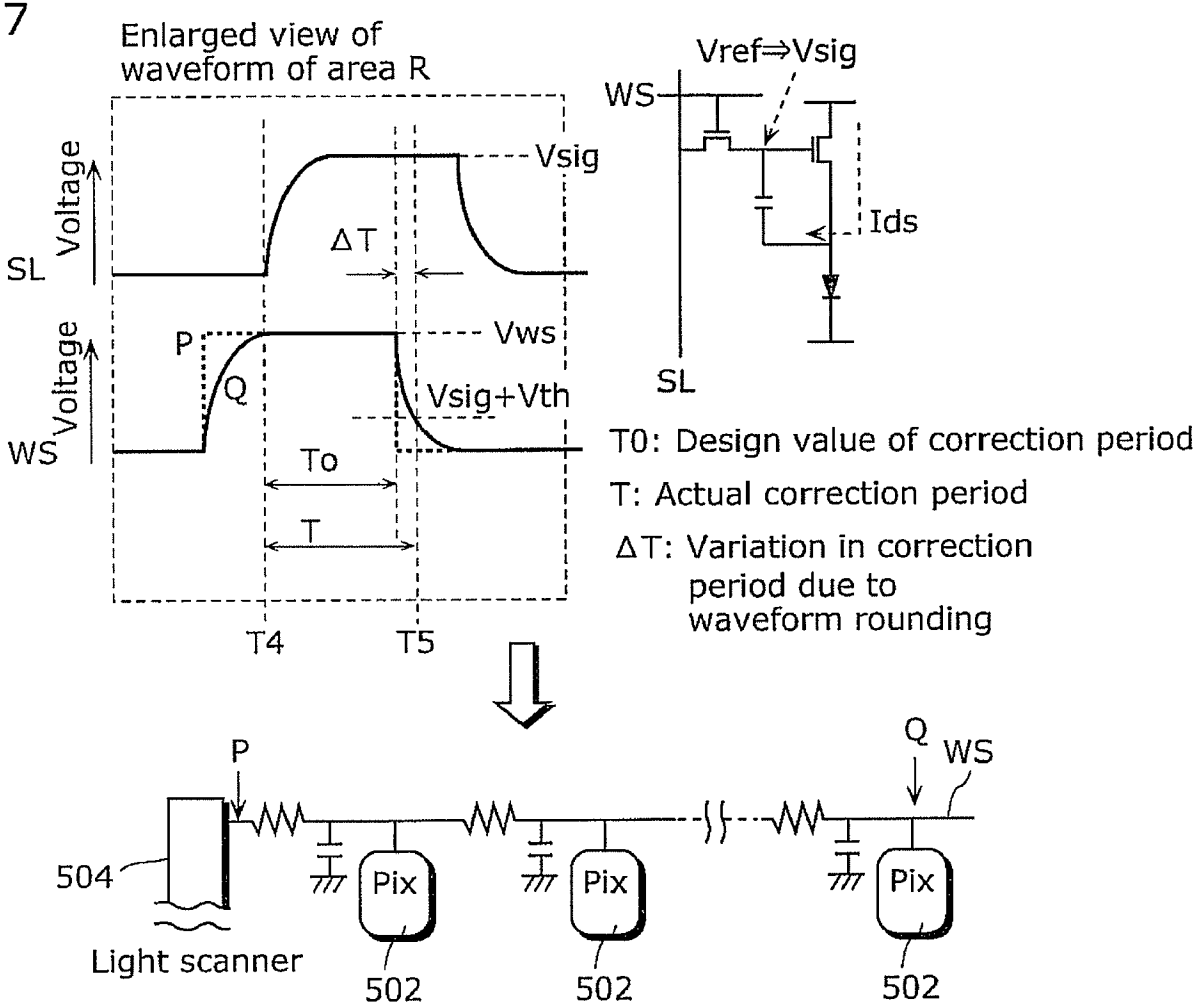
FIG. 17 is a diagram for explaining the variation in the mobility correction period in the case of the display device disclosed in Patent Literature 1.

As shown in FIG. 17, in the end time of the mobility correction period, due to the wiring delay of the scanning line WS, the voltage waveform of the scanning line WS at the point P close to the light scanner 504 is the square waveform (indicated by the short dashed line in FIG. 17) reflecting the driving voltage of the light scanner 504. On the other hand, the voltage waveform of the scanning line WS at the point Q away from the light scanner 504 has the waveform rounding at the times of rising and falling (indicated by the solid line in FIG. 17) depending on the time constant. In the case of the pixel circuit shown in FIG. 14 in this state, for example, the mobility correction period according to the conventional method ends when the voltage between the gate and the source of the sampling transistor 506 reaches the threshold voltage Vth of the sampling transistor 506. To be more specific, this is the time when the scanning voltage $V_{ws}$ applied to the gate of the sampling transistor 506 decreases to the potential which is the sum of the source potential of the sampling transistor 506 and the threshold voltage Vth. Thus, the end times of the mobility correction are different at the points P and Q. The maximum value of the mobility correction period is T0 at the point P as shown in FIG. 17, and is T0+ΔT at the point Q as shown in FIG. 17. Moreover, at the point Q, the variation in the mobility correction period is caused from the change in the shade of gray. This is because, for example, when the signal voltage Vsig varies from 1V to 7V due to the change in the shade of gray and thus has a variation range of 6V, this means that the source potential of the sampling transistor 506 also has the variation range of 6V. Meanwhile, the variation in the mobility correction period caused from the change in the shade of gray is almost 0 at the point P. The variation in the mobility correction period at the point Q depends on a distance from the light scanner 504. That is, the variation depends on the amount of delay of the scanning line. In other words, the variation in the mobility correction period caused from the change in the shade of gray is different for each luminescence pixel.

Figure 5:
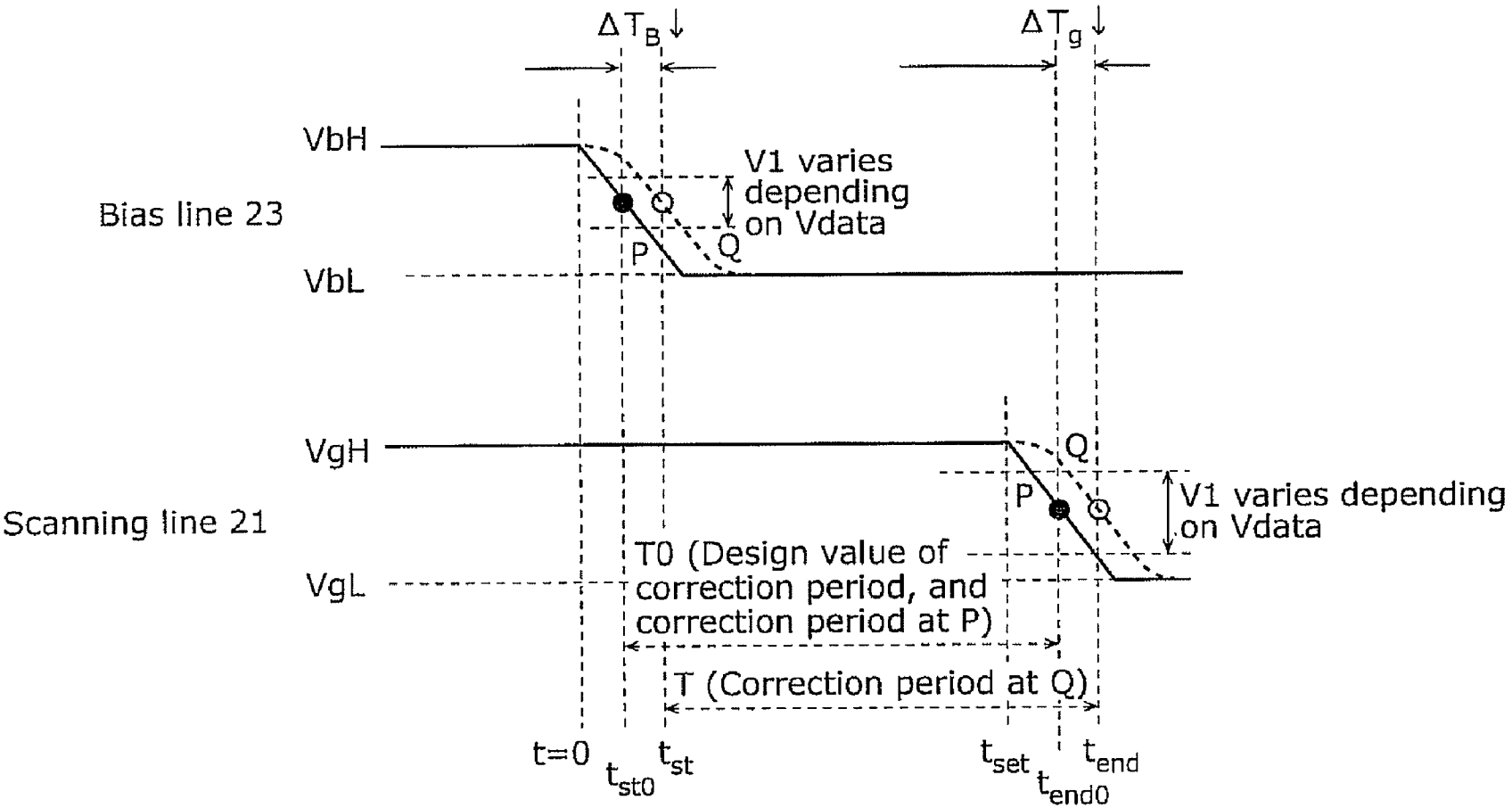
FIG. 5 is a diagram for explaining a mobility correction period of the display panel device of the present invention.

FIG. 5 is a diagram for explaining the mobility correction period of the display panel device of the present invention.

In the case of the display panel device and the control method thereof in the first embodiment of the present invention, the amount of delay according to the time constant of the bias line 23 is caused in the start time of the mobility correction, and the amount of delay according to the time constant of the scanning line 21 is caused in the end of the mobility correction.

As shown in an upper part of FIG. 5, due to the wiring delay of the bias line 23, the voltage waveform of the bias line 23 generated in the start time of the mobility correction period at the point P, which is close to the bias line driving circuit 3, is a ramp waveform (indicated by a solid line in FIG. 5) reflecting the driving voltage of the bias line driving circuit 3. On the other hand, the voltage waveform of the bias line 23 at the point Q, which is away from the bias line driving circuit 3, has waveform rounding (indicated by a short dashed line in FIG. 5) depending on the time constant, at the times of rising and falling. In this state, the mobility correction starts when the voltage between the gate electrode and the source electrode of the driving transistor 11, expressed as V1−V2, shown in FIG. 2 is increased to the threshold voltage Vth in the transition period. In the transition period, the voltage of the bias line 23 changes from the predetermined voltage VbH to the reverse bias voltage VbL. At this time, the driving transistor 11 is turned ON, and the discharge current starts flowing from the source electrode of the driving transistor 11 to the second capacitor electrode of the capacitor 14. With respect to a predetermined signal voltage, the start time of the mobility correction here is approximately $t_{st0}$ at the point P and is $t_{st}$ at the point Q. To be more specific, the start time $t_{st}$ of the mobility correction at the point Q lags behind the time $t_{st0}$ by a time delay $\Delta Tb\downarrow(t_{st}-t_{st0})$. The time $t_{st0}$ is a design value of the start time of the mobility correction corresponding to the voltage variation applied to the bias line 23 by the bias line driving circuit 3.

Meanwhile, as shown in a lower part of FIG. 5, due to the wiring delay of the scanning line 21, the voltage waveform of the scanning line 21 generated at the end time of the mobility correction period at the point P, which is close to the scanning line driving circuit 4, is a ramp waveform (indicated by a solid line in FIG. 5) reflecting the driving voltage of the scanning line driving circuit 4. On the other hand, the voltage waveform of the scanning line 21 at the point Q, which is away from the scanning line driving circuit 4, has waveform rounding (indicated by a short dashed line in FIG. 5) depending on the time constant, at the times of rising and falling. In this state, the mobility correction ends when the voltage between the gate electrode and the source electrode of the selection transistor 12 reaches the threshold voltage Vth21 of the selection transistor 12 in the transition period. In the transition period, the voltage of the scanning line 21 changes from the scanning signal voltage VgH to the scanning signal voltage VgL. At this time, the gate electrode of the driving transistor 11 is electrically separated from the data line 20, and the voltage between the gate electrode and the source electrode of the driving transistor 11 is determined and this voltage is held. With respect to the predetermined signal voltage, the end time of the mobility correction here is approximately $t_{end0}$ at the point P and is $t_{end}$ at the point Q. To be more specific, the end time $t_{end}$ of the mobility correction lags behind the time $t_{end0}$ by a time delay $\Delta Tb\downarrow(t_{end}-t_{end0})$. The time $t_{end0}$ is a design value of the end time of the mobility correction corresponding to the voltage variation applied to the scanning line 21 by the scanning line driving circuit 4.

On the basis of the above start and end times of the mobility correction, the mobility correction period T at the point Q is expressed as $t_{end}-t_{st0}$. When the mobility correction period is T0 at the point P where no time delay is caused, the mobility correction period T at the point Q is expressed as $T=T0+\Delta Tg\downarrow-\Delta Tb\downarrow$. Since the bias line 23 and the scanning line 21 have approximately the same signal-delay characteristics, $\Delta Tg\downarrow$ and $\Delta Tb\downarrow$ cancel each other out. Accordingly, the display device and the control method thereof in the first embodiment of the present invention can reduce the variation, which has been caused in the conventional display device only in the end time of the mobility correction period due to the locations of the luminescence pixels.

It is preferable that the degree of the gradual change in the voltage from the predetermined bias voltage VbH to the reverse bias voltage VbL be equivalent to the degree of the gradual change from VgH to VgL in the scanning signal voltage applied to the selection transistor 12. With this, the amount of delay $\Delta Tg\downarrow$ in the start time and the amount of delay $\Delta Tb\downarrow$ in the end time more accurately correspond to each other and, thus cancel each other out.

Moreover, in the present embodiment, both the bias voltage of the bias line 23 that determines the start time of the mobility correction and the scanning signal voltage of the scanning line 21 that determines the end time of the mobility correction are caused to be generated in the ramp waveforms so that the changes in the respective voltages are gradual.

Figure 6B:
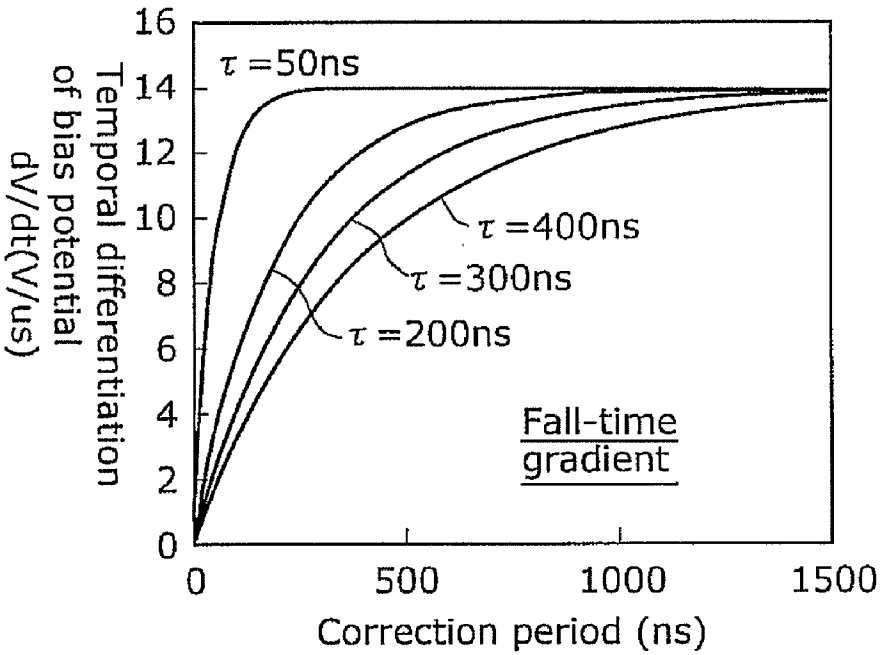
FIG. 6B is a graph showing gradient characteristics of the transient response characteristics when the bias voltage falls.
Figure 6A:
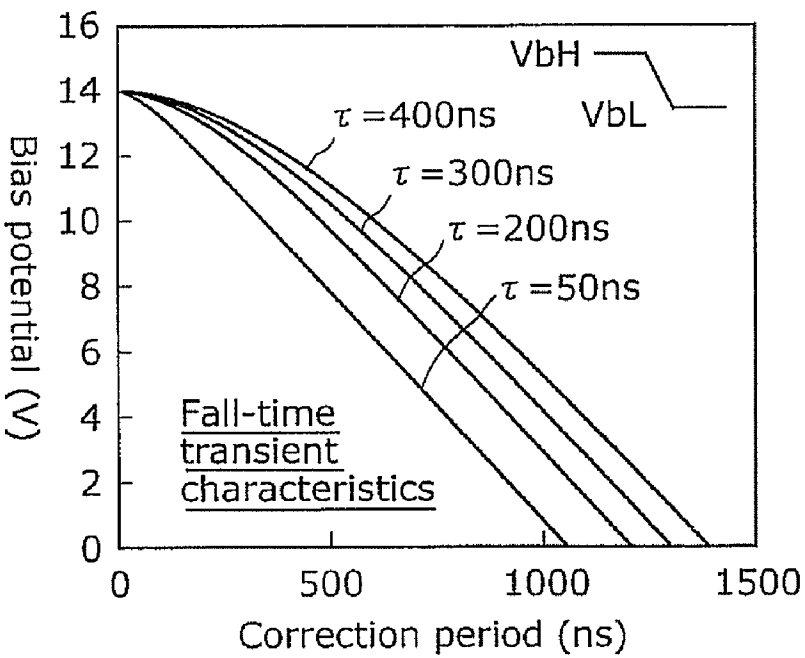
FIG. 6A is a graph showing transient response characteristics when a bias voltage falls.

FIG. 6A is a graph showing the transient response characteristics when the bias voltage falls. FIG. 6B is a graph showing gradient characteristics of the transient response characteristics when the bias voltage falls. FIG. 6A shows time displacements of the bias potential for each point on the bias line 23 when the bias line driving circuit 3 supplies the bias line 23 with the ramp waveform, where the transition period is 1 μl sec, VbH is 14V, and VbL is 0V. As shown, the smaller the time constant τ, the smaller the difference with the ramp waveform supplied from the bias line driving circuit 3. Also, the larger the time constant τ, the larger the difference with the ramp waveform, causing large rounding. This gradient is shown in FIG. 6B. In a first half of the correction period, the differences in gradient at the times of rising are large depending on the time constants τ. In a latter half of the correction period, on the other hand, the gradients tend to equate with each other even when the time constants τ are different.

According to the transient response characteristics at the time of falling as described above, the bias voltage supplied from the bias line driving circuit 3 to the bias line 23 is generated as the ramp waveform. Thus, the voltage is caused to gradually change over a predetermined transition period of time. This allows the gradients of the delay characteristics of the writing voltage held in the capacitor 15 included for each luminescence pixel to become uniform. Also, in the case where the scanning signal voltage supplied from the scanning line driving circuit 4 to the scanning line 21 is generated as the ramp waveform in which the voltage is caused to gradually change over the predetermined transition period of time, the same graph characteristics as those shown in FIGS. 6A and 6B can be acquired.

Each of the start time $t_{st}$ and the end time $t_{end}$ of the mobility correction varies according to the magnitude of the signal voltage Vdata. However, by making the gradients of the delay characteristics uniform, the variation in the mobility correction period caused due to the variation range of the signal voltage Vdata can be reduced among the luminescence pixels.

With the display panel device, the display device, and the control method thereof, the influence due to the wiring delay can be lowered by reducing the variation in the mobility correction period with respect to a shade of gray to be displayed. Accordingly, the variation in the mobility correction can be reduced in all shades of gray.

In the present embodiment, each of the bias voltage supplied from the bias line driving circuit 3 to the bias line 23 and the scanning signal voltage supplied from the scanning line driving circuit 4 to the scanning line 21 is generated as the ramp waveform. However, the present invention is not limited to this. For example, each of the voltages does not need to be caused to linearly change in the transition period, and may be generated as a quadratic curve.

Next, an explanation is given about the advantageous effects of the display panel device, the display device, and the control method thereof in the first embodiment of the present invention. The effects are produced through calculation of the mobility correction period from the transient characteristics of the bias voltage and the scanning signal voltage.

Figure 7:
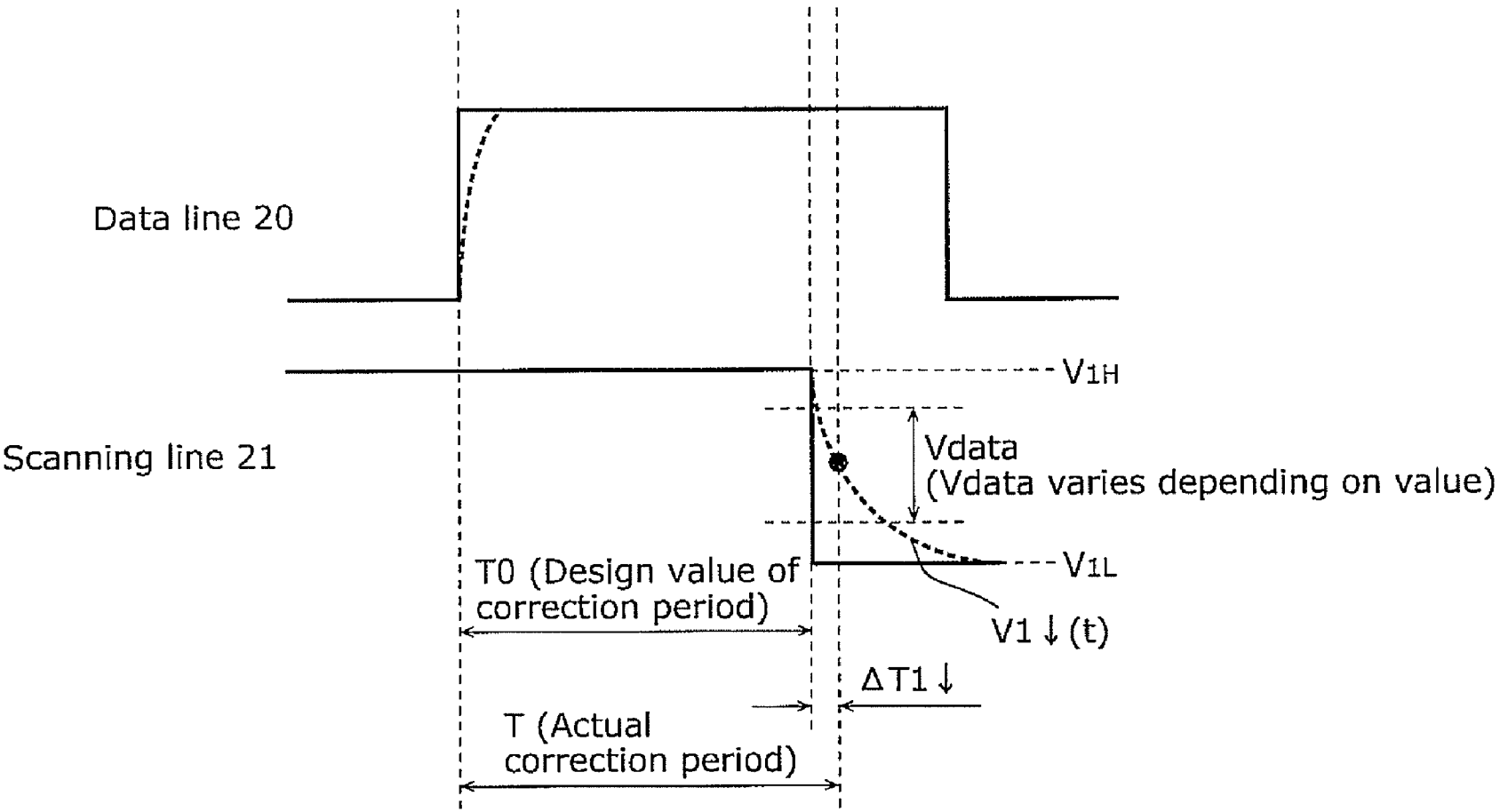
FIG. 7 is a diagram for explaining calculation parameters for the mobility correction period in the case of a conventional method.
Figure 15:
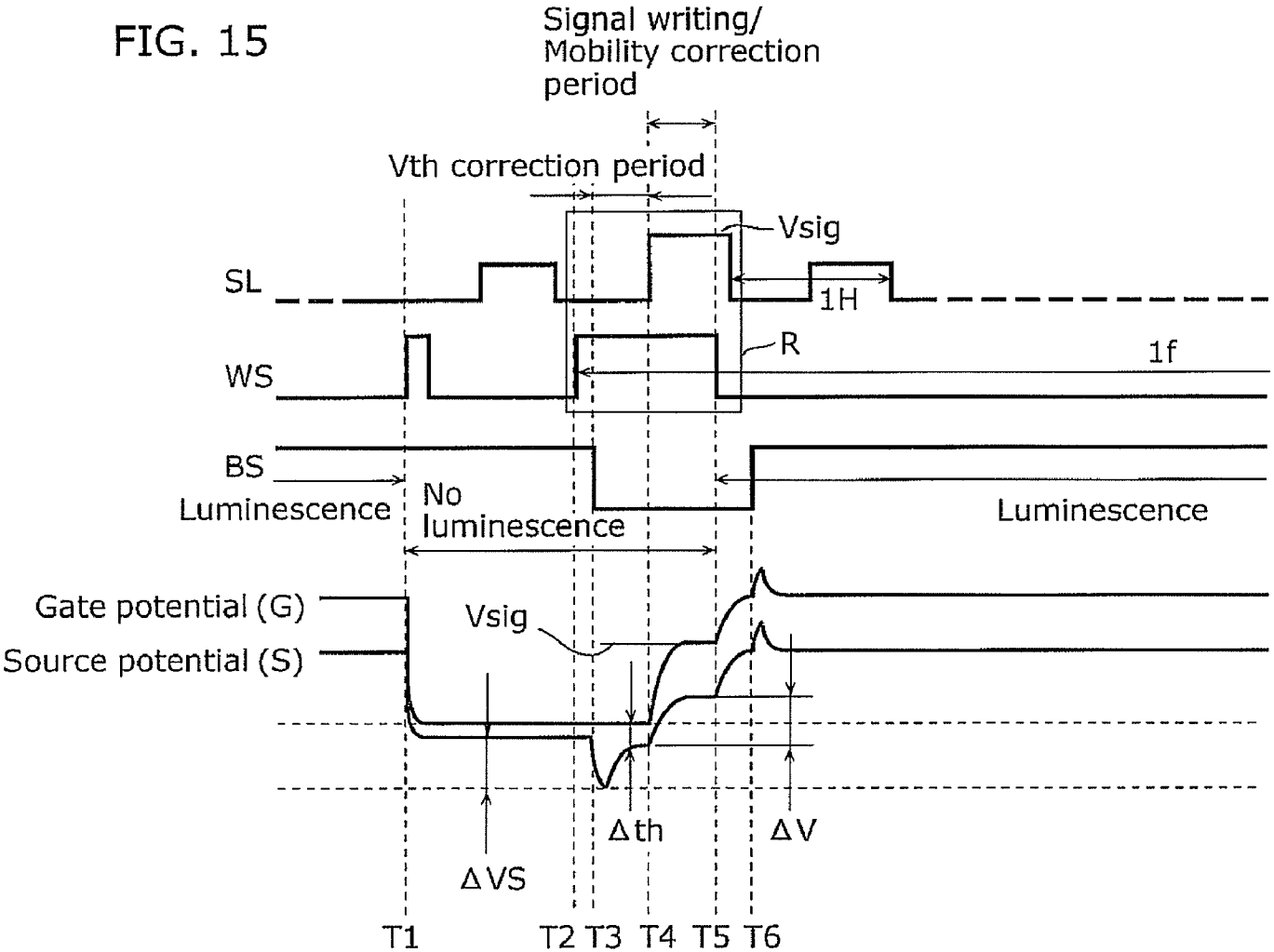
FIG. 15 is an operation timing chart of the conventional display device disclosed in Patent Literature 1.
Figure 16:
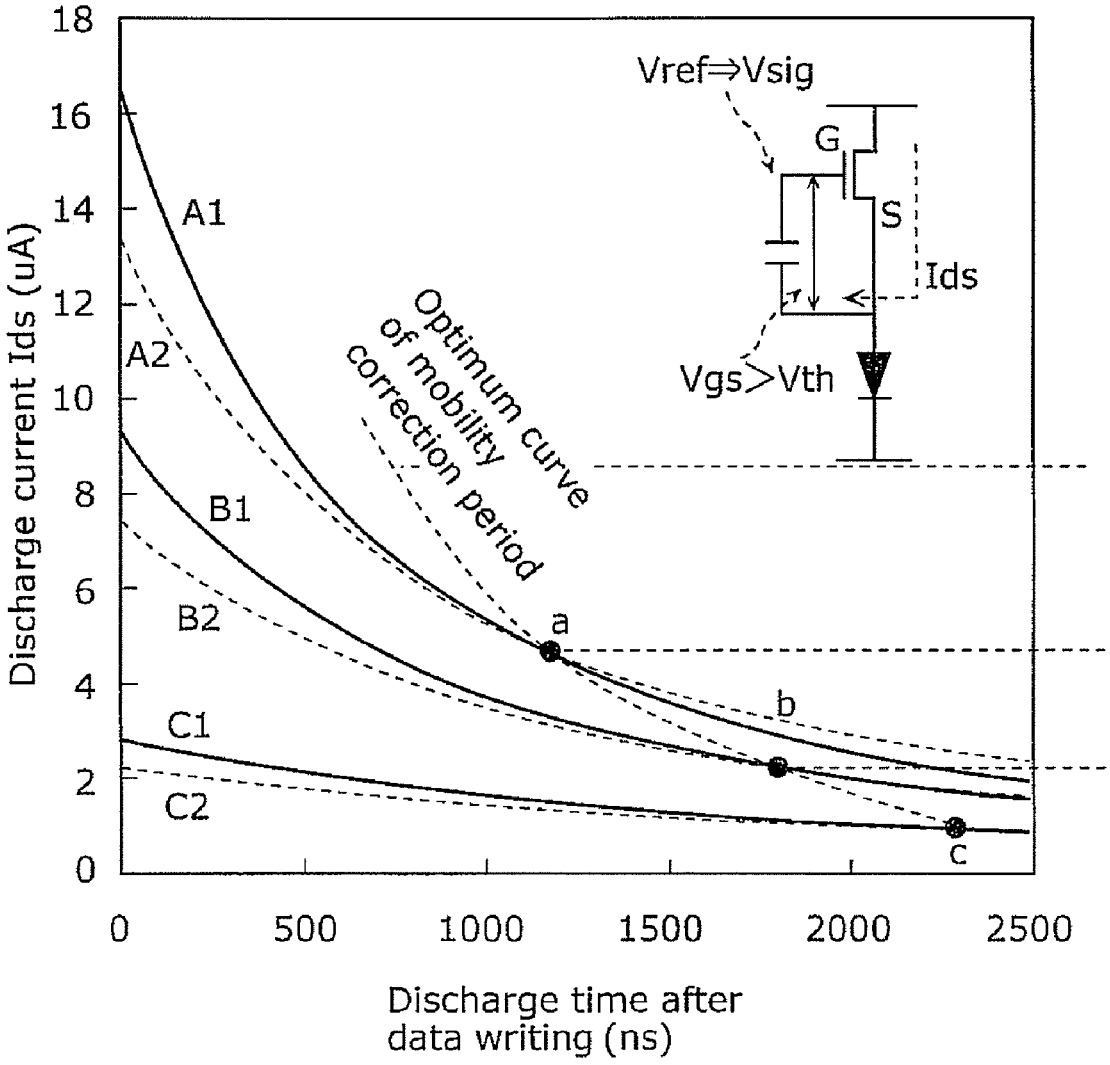
FIG. 16 is a graph showing characteristics of the discharge current of the capacitor in the mobility correction period.

FIG. 7 is a diagram for explaining calculation parameters for the mobility correction period in the case of the conventional method. As is the case with the timing chart of FIG. 15, the scanning line WS, which is the equivalent of the scanning line 21, is previously turned ON at the time T2. After this, the mobility correction period starts at the time T4 when the signal voltage Vdata is applied from the data line 20 to the gate electrode of the driving transistor 11. Also, as described above, the mobility correction in the conventional case ends when the potential difference between the source electrode of the selection transistor 12 (which is the equivalent of the sampling transistor 506 in FIG. 14) and the scanning signal V1↓(t) is reduced to the threshold voltage $Vth_{21}$ of the selection transistor 12 which is then switched from the ON state to the OFF state. Thus, according to the time constant of the selection transistor 12, it is assumed that the end time lags behind the design value of the end time of the mobility correction by ΔT1↓. Thus, the mobility correction period T in the case of the conventional display device is expressed by the following equation.

[Math. 1]

$$T=T_0+\Delta T_{1\downarrow} \quad \text{(Equation 1)}$$

Moreover, when the selection transistor 12 is switched to the OFF state, that is, when the scanning signal of the scanning line 21 changes from the high level of V1H to the low level of V1L, the transient characteristics V1↓(t) of the voltage of the gate electrode of the selection transistor 12 is expressed by the following equation.

[Math. 2]

$$V_1\downarrow(t) = (V_{1L} - V_{1H})\cdot\left(1 - \exp\left(-\frac{t}{\tau_1}\right)\right) + V_{1H} \quad \text{(Equation 2)}$$

Here, in Equation 2 above, the time at which the scanning line driving circuit 4 applies the scanning signal V1L to the scanning line 21 is zero, that is, t=0. The selection transistor 12 is switched from the ON state to the OFF state according to the scanning signal when the potential difference between the voltage V1↓(t) and Vdata becomes the threshold voltage $Vth_{21}$ of the selection transistor 12. The voltage V1↓(t) is the voltage of the gate electrode of the selection transistor 12 in Equation 2. The Vdata is the potential of the source electrode of the selection transistor 12. This state is expressed by the following equation.

[Math. 3]

$$Vgs = (V_{1L} - V_{1H})\cdot\left(1 - \exp\left(-\frac{\Delta T_1\downarrow}{\tau_1}\right)\right) + V_{1H} - V_{data} = V_{th21} \quad \text{(Equation 3)}$$

The equation is accordingly derived as above.

Figure 8A:
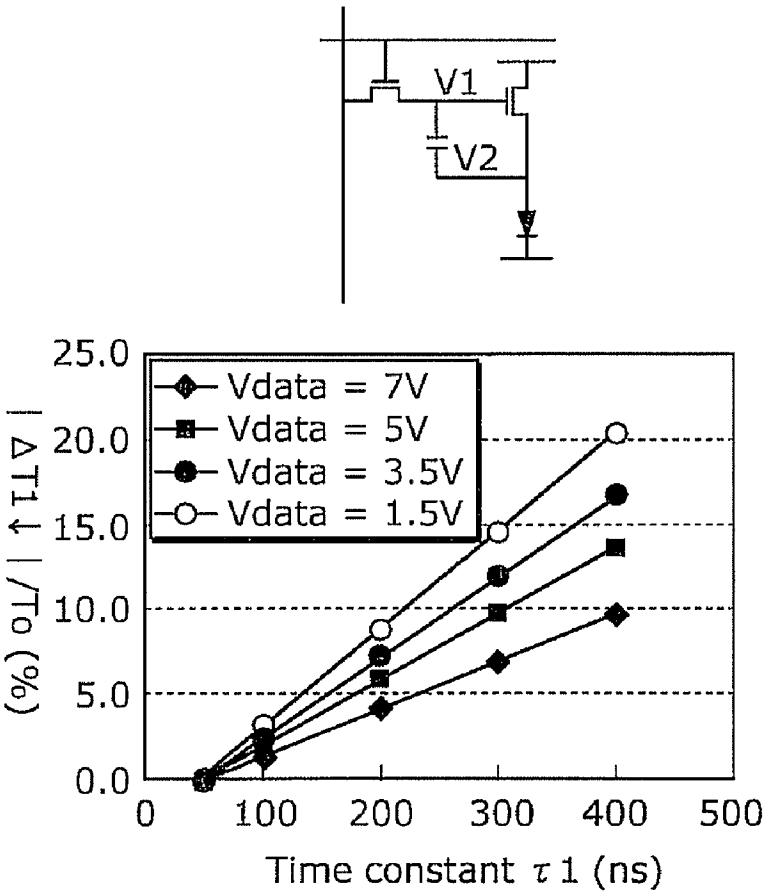
FIG. 8A is a graph showing time-constant dependence of the mobility correction period calculated using the conventional method for determining the mobility correction period.

FIG. 8A is a graph showing the time-constant dependence of the mobility correction period calculated using a conventional method for determining the mobility correction period. The horizontal axis denotes a time constant τ1 for turning the selection transistor 120N or OFF. The vertical axis denotes the ratio of the time delay ΔT1↓ of the mobility correction period to the design value T0 of the mobility correction period. This is to say, the horizontal axis shows that the larger the time constant τ1, the farther the distance between the pixel circuit and the scanning line driving circuit. The graph in this diagram shows a relationship between the time constant τ1 and ΔT1↓/T0. The relationship is determined by calculation using Equation 3 above, where Vdata is 1.5V, 3.5V, 5V, and 7V. It can be seen from this diagram that ΔT1↓/T0 monotonously increases with the increasing time constant τ1. More specifically, the farther the distance from the scanning line driving circuit, the more the value of the mobility correction period deviates from the design value.

The calculation parameters of the mobility correction period in the case of the display panel device of the present invention are explained, with reference to FIG. 5. As described earlier, when the mobility correction period is T0 at the point P where no time delay is caused, the start time of the mobility correction period T at the point Q is assumed to lag behind the time $t_{st0}$ by the time delay ΔTb↓($t_{st}-t_{st0}$). The time $t_{st0}$ is the design value of the start time of the mobility correction corresponding to the voltage variation applied to the bias line 23 by the bias line driving circuit 3. Also, it is assumed that the end time of the mobility correction period T lags behind the time $t_{end0}$ by the time delay ΔTb↓($t_{end}-t_{end0}$). The time $t_{end0}$ is the design value of the end time of the mobility correction corresponding to the voltage variation applied to the scanning line 21 by the scanning line driving circuit 4. This state is expressed by the following equation.

[Math. 4]

$$T=T_0+\Delta T_{g\downarrow}-\Delta T_{b\downarrow}=T_0+(T_{end}-T_{end0})-(T_{st}-T_{st0}) \quad \text{(Equation 4)}$$

The equation is accordingly derived as above.

Moreover, when the writing voltage of the capacitor 15 gradually changes from the predetermined bias voltage VbH to the reverse bias voltage VbL, the transient characteristics Vb↓(t) of the voltage at a connection point of the capacitor 15 and the bias line 23 is expressed by the following equation. In the equation, the gradient of the ramp waveform provided approximately from the bias line driving circuit 3 to the bias line 23 is Kb, and the time constant of the bias line 23 defined by the distance between the bias line driving circuit 3 and the luminescence pixel is τb.

[Math. 5]

$$V_b\downarrow(t) = V_{bH} - K_b\cdot t + K_b\cdot\tau_b\cdot\left(1 - \exp\left(-\frac{t}{\tau_b}\right)\right) \quad \text{(Equation 5)}$$

The equation is accordingly derived as above.

Furthermore, when the gate voltage of the selection transistor 12 gradually changes from the scanning signal voltage VgH to VgL, the transient characteristics Vg↓(t) of the gate voltage of the selection transistor 12 is expressed by the following equation. In the equation, the gradient of the ramp waveform provided approximately from the scanning line driving circuit 4 to the scanning line 21 is Kg, and the time constant of the scanning line 21 defined by the distance between the scanning line driving circuit 4 and the luminescence pixel is τg.

[Math. 6]

$$V_g\downarrow(t) = V_{gH} - K_g \cdot t + K_g \cdot \tau_g \cdot \left(1 - \exp\left(-\frac{t}{\tau_g}\right)\right) \quad \text{(Equation 6)}$$

The equation is accordingly derived as above.

Here, at the start time $t_{st}$ of the mobility correction at the point Q, the voltage at the connection point of the capacitor 15 and the bias line 23 can be expressed in the following equation. In the equation, an electrostatic capacitance of the capacitor 15 is C2 and an electrostatic capacitance of the organic EL element 13 is Cel.

[Math. 7]

$$V_{bH} - K_g \cdot t_{st} + K_b \cdot \tau_b \cdot \left(1 - \exp\left(-\frac{t_{st}}{\tau_b}\right)\right) = V_{bL} + \frac{C_2 + C_{el}}{C_2} \cdot (V_{data} - V_{reset}) \quad \text{(Equation 7)}$$

The equation is accordingly derived as above.

Using Equation 7 above, the start time $t_{st}$ of the mobility correction in the case where the time constant τb and the signal voltage Vdata of the bias line 23 are caused to vary can be determined by calculation.

Meanwhile, the end time $t_{end}$ of the mobility correction can be expressed by the following equation. In the equation, the time at which the scanning line driving circuit 4 causes the scanning line 21 to start gradually changing the scanning signal voltage from VgH to VgL is a time $t_{set}$, and a period of time between the time $t_{set}$ and the end time $t_{end}$ of the mobility correction is $\Delta t_{end}$.

[Math. 8]

$$t_{end} = t_{set} + \Delta t_{end} \quad \text{(Equation 8)}$$

The transient characteristics Vg↓(t) of the gate voltage of the selection transistor 12 at the time $t_{end}$ can be expressed by the following equation using $\Delta t_{end}$, since the transient characteristics are the sum of the source voltage and the threshold voltage $Vth_{21}$ of the selection transistor 12.

[Math. 9]

$$V_{gH} - K_g \cdot \Delta t_{end} + K_g \cdot \tau_g \cdot \left(1 - \exp\left(-\frac{\Delta t_{end}}{\tau_g}\right)\right) = V_{data} + V_{th_{21}} \quad \text{(Equation 9)}$$

The equation is accordingly derived as above.

The end time $\Delta t_{end}$ of the mobility correction in the case where the time constant τg and the signal voltage Vdata of the scanning line 21 are caused to vary can be determined by calculation using Equation 9 above. Also, the time $t_{end}$ can be determined by calculation using Equation 8.

Also, the following expression can be obtained approximately from the ramp waveforms of the bias voltage and the scanning signal voltage.

[Math. 10]

$$t_{st0} = \frac{V_{bH} - K_{bL} - V_{data} + V_{reset}}{K_b} \quad \text{(Equation 10)}$$

$$t_{end0} = \frac{V_{gH} - V_{data} - V_{th}}{K_g} + t_{set}$$

The equation is accordingly derived as above.

Using Equations 7, 9, and 10 above, the times $t_{st}$, $t_{st0}$, $t_{end}$, and $t_{end0}$ are determined by calculation where τb, τg, and Vdata are caused to vary. By substituting these determined values into Equation 4, the mobility correction period T at the point Q is determined by calculation.

Figure 8B:
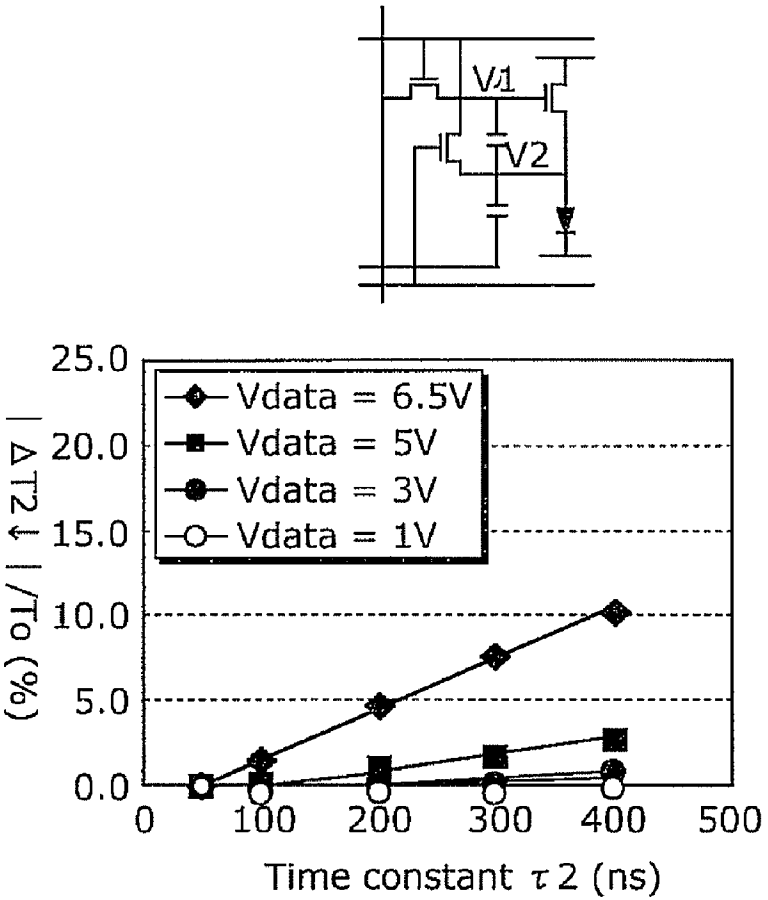
FIG. 8B is a graph showing time-constant dependence of the mobility correction period calculated using a method for determining the mobility correction period for the display panel device in the first embodiment of the present invention.

FIG. 8B is a graph showing the time-constant dependence of the mobility correction period calculated using the method for determining the mobility correction period for the display panel device in the first embodiment of the present invention. The horizontal axis denotes the time constant τ2 for switching the writing voltage of the capacitor 15 and the gate voltage of the selection transistor 12. The vertical axis denotes the ratio of the time delay ΔT2↓ of the mobility correction period T to the design value T0 of the mobility correction period. The time delay ΔT2↓ is expressed as ΔTg↓−ΔTb↓. This is to say, the horizontal axis shows that the larger the time constant τ2, the farther the distance between the pixel circuit and the scanning line driving circuit. The graph in this diagram shows a relationship between the time constant τ2 (=τb=τg) and ΔT2↓/T0. The relationship is determined by calculation using Equations 7, 9, and 10 above, where Vdata is 1V, 3V, 5V, and 6.5V. It can be seen from this diagram that ΔT2↓/T0 monotonously increases with the increasing time constant τ2. More specifically, the farther the distance from the scanning line driving circuit, the more the value of the mobility correction period deviates from the design value.

However, when the characteristics of the conventional mobility correction period shown in FIG. 8A is compared with the characteristics of the mobility correction period of the display panel device of the present invention shown in FIG. 8B, it can be seen that ΔT2↓/T0 in the case of the display panel device of the present invention shown in FIG. 8B is smaller.

Moreover, it can be seen that ΔT2↓/T0 in the case of the display panel device of the present invention shown in FIG. 8B is particularly reduced in the variation range with respect to the changes_from the low signal voltage to the medium signal voltage.

From the above evaluation result, it is understood that, in the case of the conventional display device, the time delay is caused only in the end time of the mobility correction according to the time constant of the scanning line. This results in the variation in the mobility correction period. Meanwhile, it is understood that, in the case of the display device in the first embodiment of the present invention, the time delay is caused in the start time of the mobility correction according to the time constant of the bias line 23 and the time delay is caused in the end time of the mobility correction according to the time constant of the scanning line 21. On account of this, the amount of the time delay in the start time and the amount of the time delay in the end time cancel each other out in the mobility correction period for each luminescence pixel. Therefore, the variation in the mobility correction period caused according to the distance from the driving circuit is reduced. As a consequence, the mobility of the driving transistor 11 can be corrected with accuracy.

Moreover, when the reverse bias voltage is written to the capacitor 15 via the bias line 23, the voltage is caused to gradually change from the predetermined bias voltage to the reverse bias voltage. With this, the influences of the signal voltage changes and of the wiring delay can be lowered and, thus, the variation in the mobility correction can be reduced in all shades of gray. Consequently, the variations in luminescence caused between, for example, the marginal area and the central area of the display panel device can be prevented. Also, the unevenness in the amount of luminescence caused, for example, between the marginal area and the central area of the display panel device can be prevented in all shades of gray.

Second Embodiment

A display panel device in the present embodiment is different from the display panel device in the first embodiment in the pixel circuit configuration and in the driving timing thereof. As the pixel circuit configuration, a luminescence pixel 30 of the present embodiment is different from the luminescence pixel 10 of the first embodiment in that the switching transistor 16 is arranged between the source electrode of the driving transistor 11 and the anode electrode of the organic EL element 13, and in that the scanning signal voltage of the scanning line 21 is not applied to the second capacitor electrode of the capacitor 14. Hereinafter, only the different parts are explained and thus the explanation of the identical parts to those in the circuit configuration of the first embodiment is omitted.

Figure 9:
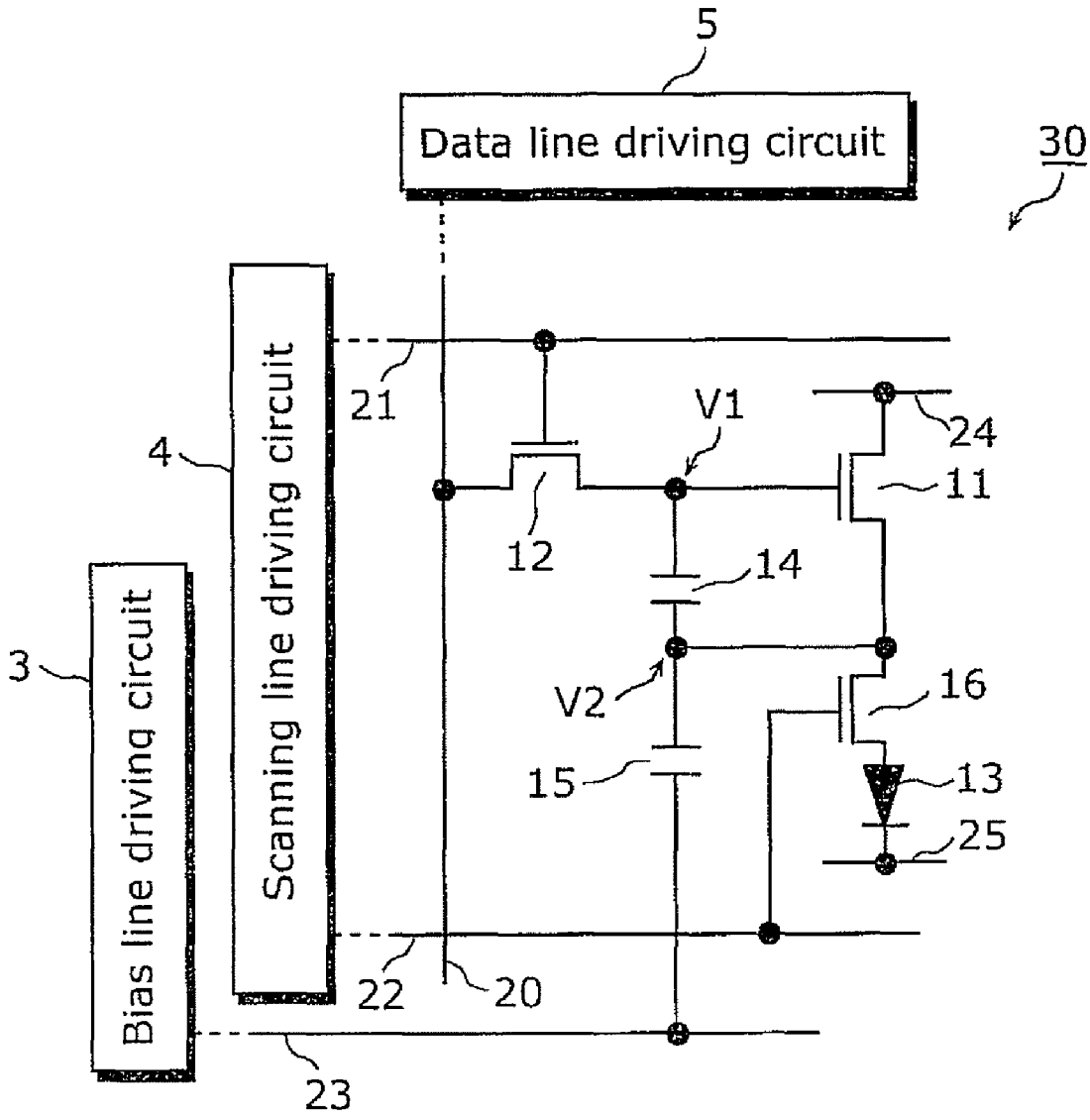
FIG. 9 is a diagram showing a configuration of a luminescence pixel circuit included in a display unit and connections between the luminescence pixel circuit and peripheral circuits thereof in a second embodiment of the present invention.

FIG. 9 is a diagram showing a configuration of a luminescence pixel circuit included in the display unit and connections between the luminescence pixel circuit and peripheral circuits thereof in the second embodiment of the present invention. The luminescence pixel 30 includes a driving transistor 11, a selection transistor 12, an organic EL element 13, capacitors 14 and 15, a switching transistor 16, a data line 20, scanning lines 21 and 22, a bias line 23, a positive power line 24, and a negative power line 25. As the peripheral circuits, a bias line driving circuit 3, a scanning line driving circuit 4, and a data line driving circuit 5 are provided.

Connection relationships and functions of the components shown in FIG. 9 are explained as follows.

The driving transistor 11 is a driver which includes: a gate electrode connected to a source electrode of the selection transistor 12; a drain electrode connected to the positive power line 24; and a source electrode connected to a drain electrode of the switching transistor 16 and to the second capacitor electrode of the capacitor 14. The driving transistor 11 converts a voltage applied between the gate and the source into a drain current corresponding to the voltage, and supplies this drain current, as a signal current, to the organic EL element 13. Or, the driving transistor 11 supplies this drain current, as a discharge current, to the second capacitor electrode of the capacitor 14. The driving transistor 11 is configured with an n-type thin-film transistor (n-TFT).

The switching transistor 16 includes: the gate electrode connected to the scanning line 22; the drain electrode connected to the source electrode of the driving transistor 11; and the source electrode connected to the anode electrode of the organic EL element 13. The switching transistor 16 is a second switch that switches between conduction and non-conduction between the source electrode of the driving transistor 11 and the anode electrode of the organic EL element 13.

Depending on the anode potential of the organic EL element 13, the current may flow through the organic EL element 13 which thus produces luminescence before the completion of the mobility correction of the driving transistor 11. In such a case, the desired potential difference to be obtained as a result of the mobility correction cannot be accumulated in the capacitor 14. For this reason, the variations in luminance among the pixels cannot be corrected with accuracy. In order to address this problem, the switching transistor 16 is turned OFF in the mobility correction period so that non-conduction is caused between the anode electrode of the organic EL element 13 and the source electrode of the driving transistor 11. That way, even when the signal voltage is applied to the first capacitor electrode of the capacitor 14, the drain current of the driving transistor 11 does not flow through the organic EL element 13. Accordingly, the organic EL element 13 can be prevented from producing luminescence before the completion of the mobility correction. As a result, the variations in luminescence caused by the luminescence elements among the pixels can be corrected with accuracy. Moreover, the bias voltage for applying an appropriate voltage to the second capacitor electrode of the capacitor 14 and the source electrode of the driving transistor 11 can be set without consideration of a condition where the organic EL element 13 may produce luminescence. Therefore, a degree of flexibility in setting the bias voltage is increased.

The scanning line 21 is connected to the scanning line driving circuit 4 and to each luminescence pixel that belongs to a pixel row including the luminescence pixels 30. The scanning line 21 has a function of providing a timing at which the signal voltage is to be written to each luminescence pixel that belongs to the pixel row including the luminescence pixels 30.

The scanning line 22 is connected to the scanning line driving circuit 4, and has a function of providing a timing to switch between conduction and non-conduction between the source electrode of the driving transistor 11 and the anode electrode of the organic EL element 13.

It should be noted that each of the positive power line 24 that is the first power line and the negative power line 25 that is the second power line is also connected to the other luminescence pixels and to a voltage source.

Note that each of the display panel device of the present embodiment and a display device including the above-mentioned voltage source is one aspect according to the embodiment of the present invention.

Figure 10:
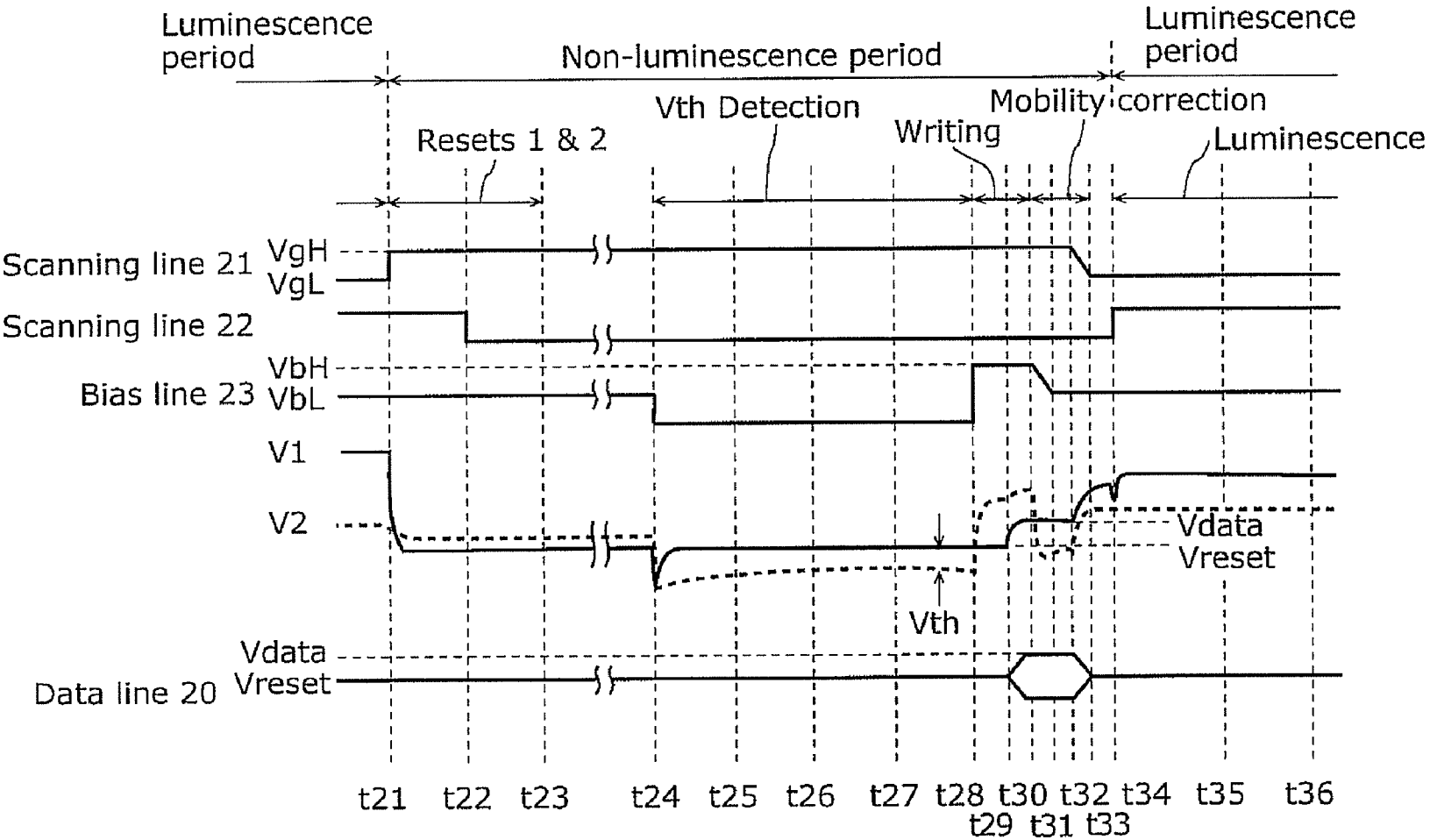
FIG. 10 is an operation timing chart of a control method for the display panel device in the second embodiment of the present invention.
Figure 11:
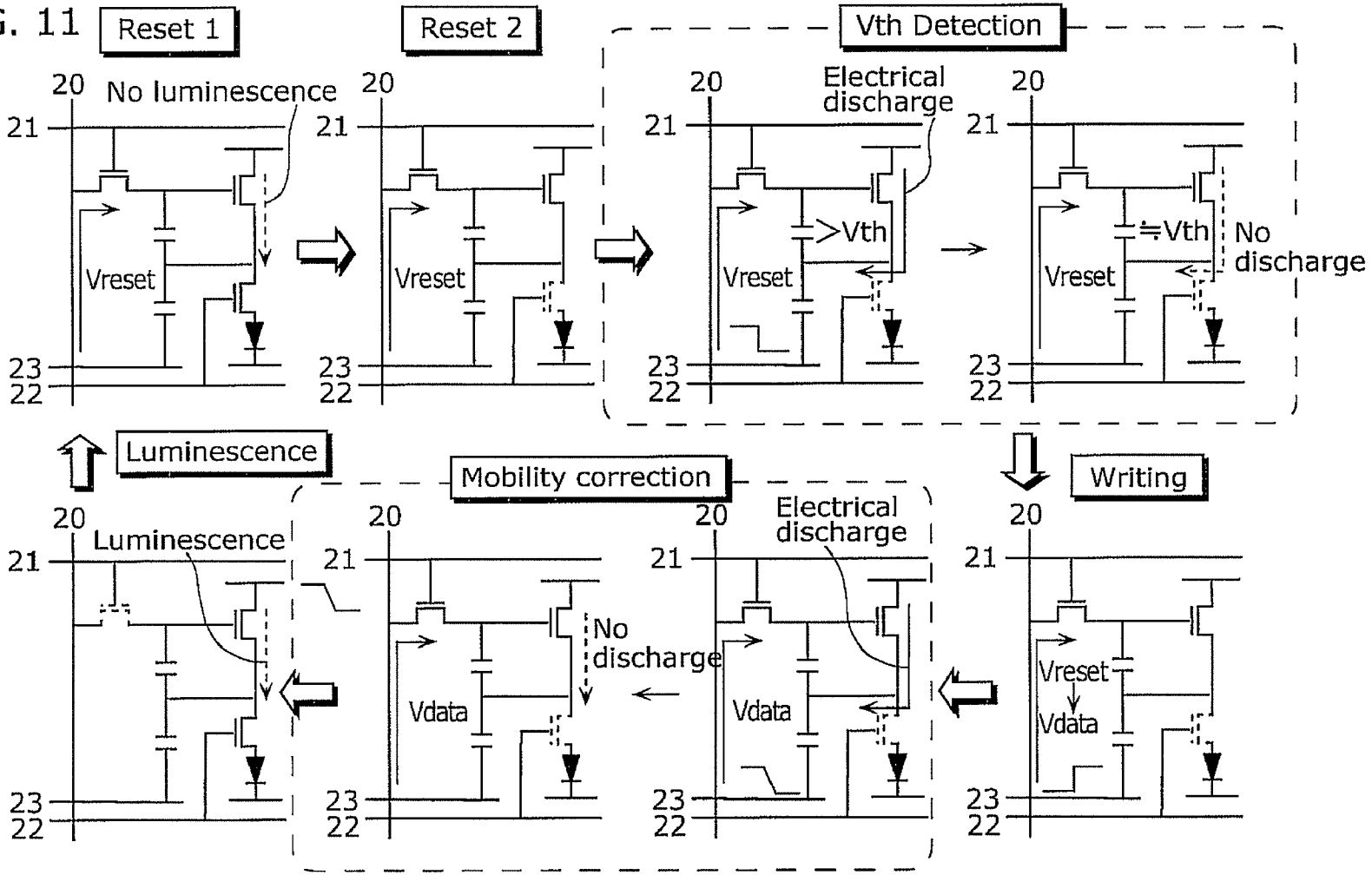
FIG. 11 is a state transition diagram of the pixel circuit included in the display panel device in the second embodiment of the present invention.

Next, the control method of the display device of the present embodiment is explained, with reference to FIGS. 10 and 11.

FIG. 10 is an operation timing chart of the control method of the display device in the second embodiment of the present invention. In this diagram, the horizontal axis denotes time. In the vertical direction, the respective waveform charts of the voltages generated in the scanning line 21, the scanning line 22, the bias line 23, a potential V1 of the first capacitor electrode of the capacitor 14, a potential V2 of the second capacitor electrode of the capacitor 14, and the data line 20 are shown in this order from the top. This diagram shows an operation performed by the display device per pixel line, and shows that one frame period includes a non-luminescence period and a luminescence period. In the non-luminescence period, the correction operations to correct a threshold voltage Vth and a mobility β of the driving transistor 11 are performed.

FIG. 11 is a state transition diagram of the pixel circuit included in the display device in the second embodiment of the present invention.

First, at a time t21, the scanning line driving circuit 4 causes the voltage level of the scanning line 21 to change from LOW to HIGH, so that the selection transistor 12 is turned ON. As a result, the fixed voltage Vreset is applied to the gate electrode (V1) of the driving transistor 11 via the data line 20. Here, the luminescence period of a previous frame accordingly ends. In a period from the time t21 to a time t22, luminescence is not produced. This state corresponds to a state of Reset 1 shown in FIG. 11.

Next, at the time t22, the scanning line driving circuit 4 causes the voltage level of the scanning line 21 to change from HIGH to LOW and causes non-conduction between the source electrode of the driving transistor 11 and the anode electrode of the organic EL element 13. With this, in the threshold voltage correction period and the mobility correction period afterward, the drain current of the driving transistor 11 does not flow through the organic EL element regardless of the voltage applied to the second capacitor electrode of the capacitor 14. In a period from the time t22 to a time t23, luminescence is not produced. This state corresponds to a state of Reset 2 shown in FIG. 11.

Next, at a time t24, the bias line driving circuit 3 applies the second reverse bias voltage to the capacitor 15 via the bias line 23. At this time, the fixed voltage Vreset is kept applied to the first capacitor electrode of the capacitor 14 from the data line 20. By this voltage and the stated second reverse bias voltage, a potential difference larger than the threshold voltage Vth of the driving transistor 11 is caused between both of the electrodes of the capacitor 14. Thus, the driving transistor 11 is turned ON, and the discharge current flows through a current path from the positive power line 24 to the source electrode of the driving transistor 11 and to the second capacitor electrode of the capacitor 14. The above-mentioned discharge current flows in the period from the time t24 to a time t28. With the passage of time, when the voltage held by the capacitor 14 becomes Vth, the discharge current which is the drain current of the driving transistor 11 stops flowing. As a result, an electrical charge corresponding to the threshold voltage Vth is accumulated in the capacitor 14. During this period, the drain current does not flow through the organic EL element 13 since the switching transistor 16 is turned OFF. The period from the time t24 to the time t28 corresponds to a state of Vth Detection shown in FIG. 11.

Next, at the time t28, the bias line driving circuit 3 causes the voltage level of the bias line 23 to change from the second reverse bias voltage to a predetermined bias voltage VbH. Here, the predetermined bias voltage VbH is such that, even when a signal voltage Vdata is to be supplied to the first capacitor electrode of the capacitor 14 at a time t29, the potential of the first capacitor electrode with respect to the second capacitor electrode of the capacitor 14 becomes equal to or lower than the threshold voltage Vth. For this reason, at the time t28, the drain current does not flow between the source electrode of the driving transistor 11 and the second capacitor electrode of the capacitor 14.

Next, at the time t29, the data line driving circuit 5 supplies the signal voltage Vdata to the first capacitor electrode of the capacitor 14 in the state where the drain current does not flow between the source electrode of the driving transistor 11 and the second capacitor electrode of the capacitor 14 and where the selection transistor 12 is turned ON. Here, as described above, the potential of the first capacitor electrode with respect to the second capacitor electrode of the capacitor 14, that is expressed as V1−V2, is equal to or lower than the threshold voltage Vth. Hence, at the time t29, the drain current still does not flow between the source electrode of the driving transistor 11 and the second capacitor electrode of the capacitor 14. The period from the time t28 to a time t30 corresponds to a state of Writing shown in FIG. 11.

Following this, from the time t30 to a time t31, the bias line driving circuit 3 causes the voltage level of the bias line 23 to gradually change from the predetermined bias voltage VbH to the reverse bias voltage VbL. Here, this state of the gradual change in voltage of the bias line 23 refers to a state where the voltage of the bias line 23 is provided while being gradually changed over the period of time from the time t30 to the time t31. As a result of this, for example, the predetermined bias voltage VbH at the time t30 becomes the reverse bias voltage VbL at the time t31. In other words, this is not the same as in the case, for example, where the scanning line driving circuit 4 causes the scanning signal voltage to change from the LOW-level voltage VgL to the HIGH-level voltage VgH at the moment of the time t21. To be more specific, the bias line driving circuit 3 here does not cause the voltage to instantaneously change from the predetermined bias voltage VbH to the reverse bias voltage VbL at the moment of the time t30.

It should be noted that, in the present embodiment, by spending a transition period of time corresponding to a time constant of the bias line 23 in the luminescence pixel that is located in an area farthest from the bias line driving circuit 3, the bias line driving circuit 3 causes the voltage to linearly change from the predetermined bias voltage VbH to the reverse bias voltage VbL.

Accordingly, with reference to the timing to start the discharge current flow in the central area of the display panel device, the timing to start the discharge current flow is determined for a different area of the display panel device. Thus, the variations in luminescence between the marginal area and the central area of the display panel device can be prevented. Also, unevenness in the amount of luminescence between, for example, the marginal area and the central area of the display panel device can be prevented. It should be noted here that the luminescence pixel located in the central area of the display panel device is an example of a luminescence pixel arranged in an area of the display panel device that is farthest from the bias line driving circuit 3. In the case where the bias line driving circuit 3 is arranged in one of the marginal areas of the display panel device, unevenness in the amount of luminescence taking place between the luminescence pixels arranged in the present marginal area and the other marginal area of the display panel device can be prevented.

In order to implement the above-described gradual change in the bias voltage provided by the bias line driving circuit 3, the bias line driving circuit 3 of the present embodiment may include the same component as the one that is described above in the case of the first embodiment where the gradual change is caused to the output waveform of the bias voltage provided by the bias line driving circuit 3.

During this period from the time t30 to the time t31, because the signal voltage Vdata is kept applied via the selection transistor 12, the potential V1 of the first capacitor electrode of the capacitor 14 continues to hold Vdata. On the other hand, in accordance with to the gradual fall in the voltage of the bias line 23, the potential V2 of the second capacitor electrode of the capacitor 14 falls. During the period from the time t30 to the time t31, because of the time difference between V1 and V2, there is a time $t_{st}$ at which the potential of the first capacitor electrode with respect to the second capacitor electrode of the capacitor 14, that is expressed as V1−V2, becomes equal to or higher than Vth. At this time $t_{st}$, the discharge current, that is the drain current of the driving transistor 11, starts flowing between the source electrode of the driving transistor 11 and the second capacitor electrode of the capacitor 14. Thus, the time $t_{st}$ becomes a start time of the mobility correction of the driving transistor 11.

Next, from a time t32 to a time t33, the scanning line driving circuit 4 causes the voltage level of the scanning line 21 to gradually change from VgH, which is a second voltage, to VgL, which is a first voltage. Here, this state of the gradual change in voltage of the scanning line 21 refers to a state where the voltage is provided while being gradually changed over the period of time from the time t32 to the time t33. As a result of this, the HIGH-level voltage VgH at the time t32 becomes the LOW-level voltage VgL at the time t33. In other words, this is not the same as in the case, for example, where the scanning line driving circuit 4 causes the scanning signal voltage to be changed from the LOW-level voltage VgL to the HIGH-level voltage VgH at the moment of the time t21. To be more specific, the scanning line driving circuit 4 here does not cause the voltage to instantaneously change from the HIGH-level voltage to the LOW-level voltage VgL at the moment of the time t32.

It should be noted that, in the present embodiment, by spending a transition period of time corresponding to a change in the scanning signal voltage having the time constant of the scanning line 21 in the luminescence pixel that is located in an area farthest from the scanning line driving circuit 4, the scanning line driving circuit 4 causes the scanning signal voltage to linearly change from VgH to VgL.

Accordingly, with reference to the timing to end the discharge current flow in the central area of the display panel device, the timing to end the discharge current flow is determined for a different area of the display panel device. Thus, the variations in luminescence between the marginal area and the central area of the display panel device can be prevented. Also, unevenness in the amount of luminescence between, for example, the marginal area and the central area of the display panel device can be prevented. It should be noted here that the luminescence pixel located in the central area of the display panel device is an example of a luminescence pixel arranged in an area of the display panel device that is farthest from the scanning line driving circuit 4. In the case where the scanning line driving circuit 4 is arranged in one of the marginal areas of the display panel device, unevenness in the amount of luminescence taking place between the luminescence pixels arranged in the present marginal area and the other marginal area of the display panel device can be prevented.

Also, regarding the start time of the mobility correction, with reference to the timing to start the discharge current flow in the central area of the display panel device, for example, the timing to start the discharge current flow is determined for other areas of the display panel device. On account of this, the amount of delay in the start and the amount of delay in the end correspond to each other with greater accuracy and, thus cancel each other out.

In order to implement the above-described gradual change in the scanning signal voltage provided by the scanning line driving circuit 4, the scanning line driving circuit 4 of the present embodiment may include the same component as the one that is described above in the case of the first embodiment where the gradual change is caused to the output waveform of the scanning signal voltage provided by the scanning line driving circuit 4.

From the time t32 to the time t33, the potential V1 which is the source electrode potential of the selection transistor 12 is the signal voltage Vdata. As the voltage of the gate electrode of the selection transistor 12 gradually changes from VgH to VgL, the voltage between the gate and the source of the selection transistor 12 becomes the threshold voltage of the selection transistor 12 at a time $t_{end}$. Then, the selection transistor 12 is thus turned OFF here. At the time $t_{end}$, the gate electrode of the driving transistor 11 is electrically separated from the data line 20. At the same time, the discharge current, that is the drain current of the driving transistor 11, stops flowing between the source electrode of the driving transistor 11 and the second capacitor electrode of the capacitor 14. Accordingly, the time $t_{end}$ is the end time of the mobility correction of the driving transistor 11.

Unlike the conventional case, the time $t_{st}$ at which the discharge current starts flowing is not the time when the signal voltage Vdata is applied to the gate electrode of the driving transistor. The time $t_{st}$ is determined according to the reverse bias voltage applied from the bias line driving circuit 3 to the luminescence pixel via the bias line 23. On account of this, the time $t_{st}$, that is the start time of the mobility correction, has the amount of delay in the start time depending on the location of the luminescence pixel with respect to the bias line driving circuit 3. On the other hand, the time $t_{end}$ at which the discharge current stops flowing is determined, as in the conventional case, according to the scanning signal voltage applied from the scanning line driving circuit 4 to the luminescence pixel via the scanning line 21. On account of this, the time $t_{end}$, that is the end time of the mobility correction, has the amount of delay in the end time depending on the location of the luminescence pixel with respect to the scanning line driving circuit 4.

As described so far, in the case of the conventional display device, the delay is caused only in the end time of the mobility correction, according to the time constant of the scanning line. This results in the variation in the mobility correction period. Meanwhile, in the case of the display device according to the present embodiment of the present invention, the delay is caused in the start time of the mobility correction according to the time constant of the bias line 23, and the delay is caused in the end time of the mobility correction according to the time constant of the scanning line 21. Hence, the amount of delay in the start time and the amount of delay in the end time caused in each luminescence pixel cancel each other out. Thus, the variation in the mobility correction period depending on the distance from the driving circuit can be reduced. As a consequence, the mobility of the driving transistor 11 can be corrected with accuracy. The state of the period from the time t30 to the time t33 corresponds to a state of Mobility correction shown in FIG. 11.

Moreover, in the present embodiment, when the reverse bias voltage is written to the capacitor 15 via the bias line 23, the voltage is caused to gradually change from the predetermined bias voltage to the reverse bias voltage.

Thus, the time periods taken for the voltages written to the capacitors 15 respectively included in the luminescence pixels to reach the reverse bias voltages can be made as uniform as possible between, for example, the marginal area and the central area. With this, the transient responses of the discharge current can be made uniform and thus the amounts of discharge current can be made equivalent. As a result, the variations in luminescence between the marginal area and the central area of the display panel device can be prevented. Also, the unevenness in the amount of luminescence between the marginal area and the central area of the display panel device can be prevented. According to the gradual change caused in the voltage of the bias line 23 by the bias line driving circuit 3, the start time of the mobility correction is determined. Also, according to the gradual change caused in the voltage of the scanning line 21 by the scanning line driving circuit 4, the end time of the mobility correction is determined. The reason why the mobility correction period can be corrected with accuracy through these determinations is the same as the reason described above in the first embodiment with reference to FIG. 5.

Lastly, at a time t34, the scanning line driving circuit 4 causes the voltage level of the scanning line 22 to change from LOW to HIGH, and then the switching transistor 16 is turned OFF. At the same time, the drain current corresponding to the voltage of the driving transistor 11, that is expressed as V1−V2, flows through the organic EL element 13. Thus, the organic EL element 13 starts producing luminescence. At this time, the value of the voltage expressed as V1−V2 held in the capacitor 14 is a value obtained by accurately correcting the signal voltage Vdata using the threshold voltage Vth and the mobility β. A period after the time t34 corresponds to a state of Luminescence in FIG. 11.

Depending on the anode potential of the organic EL element 13, the current may flow through the organic EL element 13 which thus produces luminescence in the period from the time t28 to the time t33 in which the signal voltage is written and the mobility is corrected. In such a case, the desired potential difference to be obtained as a result of the mobility correction cannot be accumulated in the capacitor 14. For this reason, the variations in luminance among the pixels cannot be corrected with accuracy. In order to address this problem, the switching transistor 16 is turned OFF in the aforementioned period so that non-conduction is caused between the anode electrode of the organic EL element 13 and the source electrode of the driving transistor 11. That way, even when the signal voltage is applied to the first capacitor electrode of the capacitor 14, the drain current of the driving transistor 11 does not flow through the organic EL element 13. Accordingly, the organic EL element 13 can be prevented from producing luminescence during the aforementioned period. As a result, the variations in luminescence caused by the luminescence elements among the pixels can be corrected with accuracy.

Next, an explanation is given about the advantageous effects of the display panel device, the display device, and the control method thereof in the second embodiment of the present invention. The effects are produced through calculation of the mobility correction period from the transient characteristics of the bias voltage and the scanning signal voltage.

The calculation of the mobility correction period according to the conventional method was explained using Equations 1 to 3 in the first embodiment.

Figure 12B:
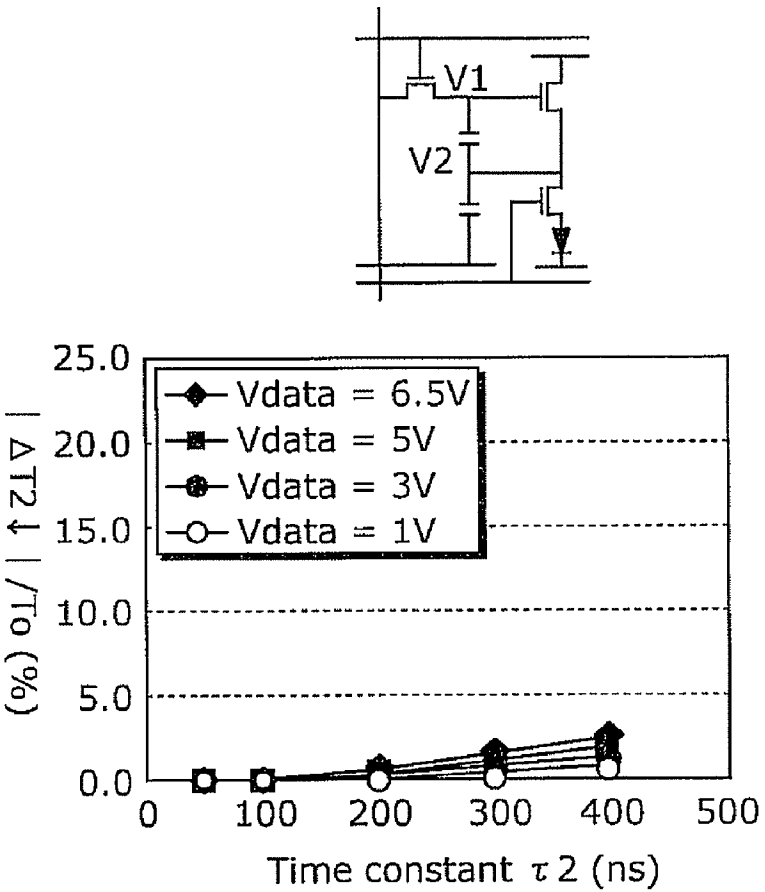
FIG. 12B is a graph showing time-constant dependence of the mobility correction period calculated using a method for determining the mobility correction period for the display panel device in the second embodiment of the present invention.
Figure 12A:
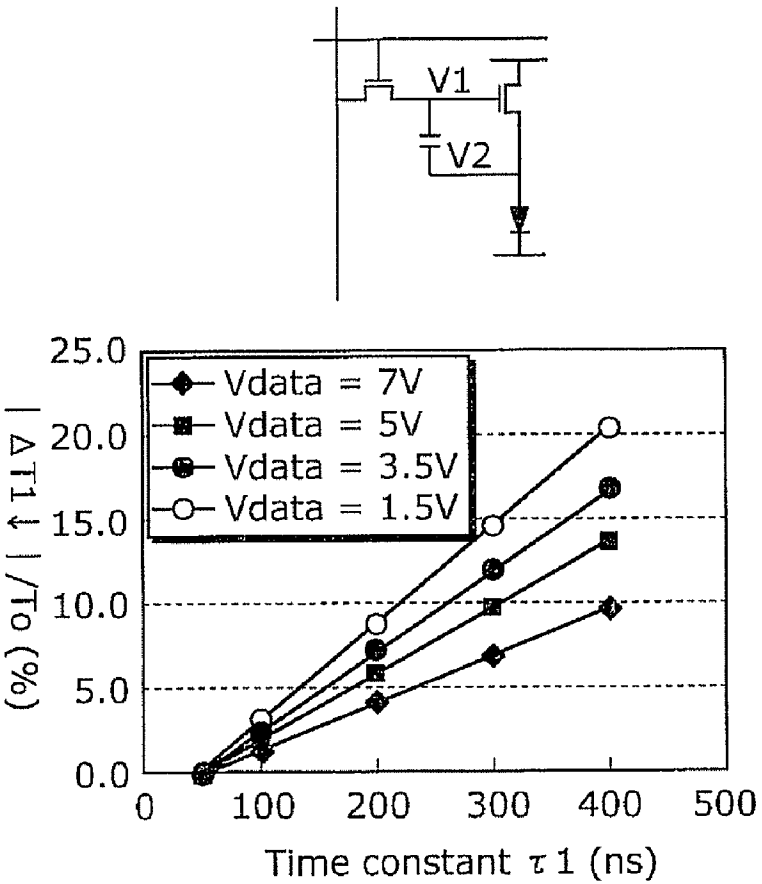
FIG. 12A is a graph showing time-constant dependence of the mobility correction period calculated using the conventional method for determining the mobility correction period.

FIG. 12A is a graph showing the time-constant dependence of the mobility correction period calculated using a conventional method for determining the mobility correction period. The graph in this diagram shows a relationship between the time constant T1 and ΔT1↓/T0. The relationship is determined by calculation using Equation 3 above, where Vdata is 1.5V, 3.5V, 5V, and 7V. It can be seen from this diagram that ΔT1↓/T0 monotonously increases with the increasing time constant τ1. More specifically, the farther the distance from the scanning line driving circuit, the more the value of the mobility correction period deviates from the design value.

The calculation parameters of the mobility correction period in the case of the display panel device of the present invention are explained, with reference to FIG. 5. As described earlier, when the mobility correction period is T0 at the point P where no time delay is caused, the start time of the mobility correction period T at the point Q is assumed to lag behind the time $t_{st0}$ by the time delay $\Delta Tb\downarrow(t_{st}-t_{st0})$. The time $t_{st0}$ is the design value of the start time of the mobility correction corresponding to the voltage variation applied to the bias line 23 by the bias line driving circuit 3. Also, it is assumed that the end time of the mobility correction period T lags behind the time $t_{end0}$ by the time delay $\Delta Tb\downarrow(t_{end}-t_{end0})$. The time $t_{end0}$ is the design value of the end time of the mobility correction corresponding to the voltage variation applied to the scanning line 21 by the scanning line driving circuit 4. This state is expressed by the following equation.

[Math. 11]

$$T=T_0+\Delta T_{g\downarrow}-\Delta T_{b\downarrow}=T_0+(t_{end}-t_{end0})-(t_{st}-t_{st0}) \quad \text{(Equation 11)}$$

The equation is according derived as above.

Moreover, when the writing voltage of the capacitor 15 gradually changes from the predetermined bias voltage VbH to the reverse bias voltage VbL, the transient characteristics Vb↓(t) of the voltage at a connection point of the capacitor 15 and the bias line 23 is expressed by the following equation. In the equation, the gradient of the ramp waveform provided approximately from the bias line driving circuit 3 to the bias line 23 is Kb, and the time constant of the bias line 23 defined by the distance between the bias line driving circuit 3 and the luminescence pixel is τb.

[Math. 12]

$$V_b\downarrow(t) = V_{bH} - K_b \cdot t + K_b \cdot \tau_b \cdot \left(1 - \exp\left(-\frac{t}{\tau_b}\right)\right) \quad \text{(Equation 12)}$$

The equation is accordingly derived as above.

Furthermore, when the gate voltage of the selection transistor 12 gradually changes from the scanning signal voltage VgH to VgL, the transient characteristics Vg↓(t) of the gate voltage of the selection transistor 12 is expressed by the following equation. In the equation, the gradient of the ramp waveform provided approximately from the scanning line driving circuit 4 to the scanning line 21 is Kg, and the time constant of the scanning line 21 defined by the distance between the scanning line driving circuit 4 and the luminescence pixel is τg.

[Math. 13]

$$V_g\downarrow(t) = V_{gH} - K_g \cdot t + K_g \cdot \tau_g \cdot \left(1 - \exp\left(-\frac{t}{\tau_g}\right)\right) \quad \text{(Equation 13)}$$

The equation is accordingly derived as above.

Here, as to the start time $t_{st}$ of the mobility correction at the point Q, the following equation can be formulated, where the reverse bias voltage is represented as VbL, the signal voltage as Vdata, and the fixed voltage as Vreset.

[Math. 14]

$$V_{bH} - K_b \cdot t_{st} + K_b \cdot \tau_b \cdot \left(1 - \exp\left(-\frac{t_{st}}{\tau_b}\right)\right) = V_{bL} + V_{data} - V_{reset} \quad \text{(Equation 14)}$$

The equation is accordingly derived as above.

Using Equation 14 above, the start time $t_{st}$ of the mobility correction in the case where the time constant τb and the signal voltage Vdata of the bias line 23 are caused to vary can be determined by calculation.

Meanwhile, the end time $t_{end}$ of the mobility correction can be expressed by the following equation. In the equation, the time at which the scanning line driving circuit 4 causes the scanning line 21 to start gradually changing the scanning signal voltage from VgH to VgL is a time $t_{set}$, and a period of time between the time $t_{set}$ and the end time $t_{end}$ of the mobility correction is $\Delta t_{end}$.

[Math. 15]

$$t_{end}=t_{set}+\Delta t_{end} \quad \text{(Equation 15)}$$

The transient characteristics Vg↓(t) of the gate voltage of the selection transistor 12 at the time $t_{end}$ can be expressed by the following equation using $\Delta t_{end}$, since the transient characteristics are the sum of the source voltage and the threshold voltage $Vth_{21}$ of the selection transistor 12.

[Math. 16]

$$V_{gH} - K_g \cdot \Delta t_{end} + K_g \cdot \tau_g \cdot \left(1 - \exp\left(-\frac{\Delta t_{end}}{\tau_g}\right)\right) = V_{data} + V_{th_{21}} \quad \text{(Equation 16)}$$

The equation is accordingly derived as above.

The end time $\Delta t_{end}$ of the mobility correction in the case where the time constant τg and the signal voltage Vdata of the scanning line 21 are caused to vary can be determined by calculation using Equation 16 above. Also, the time $t_{end}$ can be determined by calculation using Equation 15.

Also, the following expression can be obtained approximately from the ramp waveforms of the bias voltage and the scanning signal voltage.

[Math. 17]

$$t_{st0} = \frac{V_{bH} - K_{bL} - V_{data} + V_{reset}}{K_b} \quad \text{(Equation 17)}$$

$$t_{end0} = \frac{V_{gH} - V_{data} - V_{th}}{K_g} + t_{set}$$

The equation is accordingly derived as above.

Using Equations 14, 16, and 17 above, the times $t_{st}$, $t_{st0}$, $t_{end}$, and $t_{end0}$ are determined by calculation where τb, τg, and Vdata are caused to vary. By substituting these determined values into Equation 11, the mobility correction period T at the point Q is determined by calculation.

FIG. 12B is a graph showing the time-constant dependence of the mobility correction period calculated using the method for determining the mobility correction period for the display panel device in the second embodiment of the present invention. The horizontal axis denotes the time constant τ2 for switching the writing voltage of the capacitor 15 and the gate voltage of the selection transistor 12. The vertical axis denotes the ratio of the time delay ΔT2↓ of the mobility correction period T to the design value T0 of the mobility correction period. The time delay ΔT2↓ is expressed as ΔTg↓−ΔTb↓. This is to say, the horizontal axis shows that the larger the time constant τ2, the farther the distance between the pixel circuit and the scanning line driving circuit. The graph in this diagram shows a relationship between the time constant τ2 (=τb=τg) and ΔT2↓/T0. The relationship is determined by calculation using Equations 14, 16, and 17 above, where Vdata is 1V, 3V, 5V, and 6.5V. It can be seen from this diagram that ΔT2↓/T0 monotonously increases with the increasing time constant τ2. More specifically, the farther the distance from the scanning line driving circuit, the more the value of the mobility correction period deviates from the design value.

However, when the characteristics of the conventional mobility correction period shown in FIG. 12A is compared with the characteristics of the mobility correction period of the display panel device of the present invention shown in FIG. 12B, it can be seen that ΔT2↓/T0 in the case of the display panel device of the present invention shown in FIG. 12B is smaller with respect to all the time constants.

Moreover, it can be seen that ΔT2↓/T0 in the case of the display panel device of the present invention shown in FIG. 12B is significantly reduced in the variation range with respect to the changes in the signal voltage.

From the above evaluation result, it is understood that, in the case of the conventional display device, the time delay is caused only in the end time of the mobility correction according to the time constant of the scanning line. This results in the variation in the mobility correction period. Meanwhile, it is understood that, in the case of the display device in the second embodiment of the present invention, the time delay is caused in the start time of the mobility correction according to the time constant of the bias line 23 and the time delay is caused in the end time of the mobility correction according to the time constant of the scanning line 21. On account of this, the amount of the time delay in the start time and the amount of the time delay in the end time cancel each other out in the mobility correction period for each luminescence pixel. Therefore, the variation in the mobility correction period caused according to the distance from the driving circuit is reduced. As a consequence, the mobility of the driving transistor 11 can be corrected with accuracy.

Moreover, when the reverse bias voltage is written to the capacitor 15 via the bias line 23, the voltage is caused to gradually change from the predetermined bias voltage to the reverse bias voltage. With this, the influences of the signal voltage changes and of the wiring delay can be lowered and, thus, the variation in the mobility correction can be reduced in all shades of gray. Consequently, the variations in luminescence caused between, for example, the marginal area and the central area of the display panel device can be prevented. Also, the unevenness in the amount of luminescence caused, for example, between the marginal area and the central area of the display panel device can be prevented in all shades of gray.

Although the first and second embodiments have been explained, the display panel device, the display device, and the control method thereof in the present invention are not limited to these embodiments. The present invention includes: other embodiments implemented through a combination of arbitrary components of the first and second embodiments; modifications that may be conceived, through the introduction of various modifications to the first and second embodiments, by a person of ordinary skill in the art without departing from the scope of the present invention; and various devices in which the display panel device of the present invention is built.

For example, the present invention includes a display device that has the display panel device of the first or second embodiment and a power source for supplying power to the positive power line 24 and the negative power line 25. In this display device, the organic EL element includes a luminescence layer sandwiched between the anode and the cathode, and at least a plurality of luminescence pixels are arranged in a matrix.

In the first and second embodiments, the driving circuit causes the bias voltage and the scanning signal voltage to gradually change over the predetermined transition period. The bias voltage is for determining the start time of the mobility correction and the scanning signal voltage is for determining the end time of the mobility correction. However, the bias voltage and the scanning signal voltage do not need to be gradually changed, and may be caused to instantaneously change and be provided. To be more specific, the transition period of the output voltage for determining the mobility correction period may be the same as the transition period in the case where the scanning line driving circuit 4 causes the scanning signal voltage to instantaneously change from VgL to VgH. Even in such a case, the time delays depending on the distances from the driving circuit are caused in the start and end times of the mobility correction respectively according to the time constants of the bias line and the scanning line. Having correlation with each other, these time delays cancel each other out. As compared with the conventional correction period having the time delay only in the end time of the mobility correction, the mobility correction period can be controlled with accuracy. As a result, the mobility of the driver can be corrected with accuracy.

In the first embodiment, the scanning signal voltage VgL of the scanning line 21 for controlling the ON and OFF states of the switching transistor 16 is used as the reference voltage. However, note that the reference voltage may be a signal voltage of a scanning line or a control line that is different from the scanning line 21. In this case, the reference voltage is not limited by the value of the scanning signal voltage for turning ON or OFF the selection transistor 12. Therefore, a degree of flexibility in setting the reference voltage value is increased.

In the above embodiments, the selection transistor and the switching transistor are described as n-type transistors which are turned ON when the voltage levels of their gates become HIGH. However, these transistors may be formed by p-type transistors and thus the polarity of the scanning line may be reversed. Even in the case of such a display panel device and such a display device, the same advantageous effects as described in the above embodiments can be produced.

Figure 13:
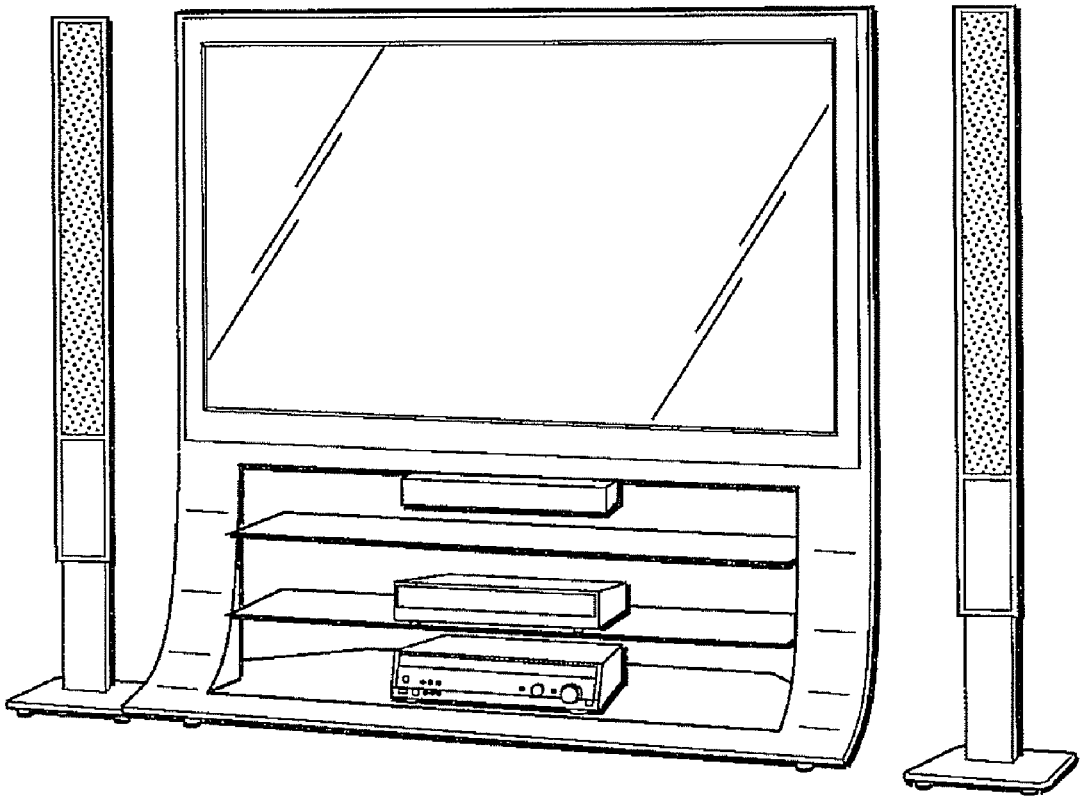
FIG. 13 is an external view of a thin flat TV with a built-in display panel device of the present invention.

Moreover, the display panel device, the display device, or the control method thereof in the present invention is built in a thin flat TV shown in FIG. 13, for example. With this built-in display panel device or display device of the present invention, the thin flat TV can be implemented in which the occurrence of variations in luminance due to the variations in the threshold voltage Vth and the mobility β is reduced.

INDUSTRIAL APPLICABILITY

The display panel device, the display device, and the control method thereof in the present invention are particularly useful as an active organic EL flat panel display which changes luminance by controlling luminescence intensity of a luminescence pixel using a pixel signal current corresponding to a shade of gray to be displayed.

What is claimed is:

1. A display panel device, comprising:

a luminescence element including a first luminescence electrode and a second luminescence electrode;

a first capacitor including a first capacitor electrode and a second capacitor electrode that holds a capacitor voltage;

a driver including a driver gate electrode, a driver drain electrode, and a driver source electrode that drives the luminescence element to produce a luminescence by flowing a drain current corresponding to the capacitor voltage through the luminescence element, the driver gate electrode connected to the first capacitor electrode, the driver source electrode connected to the second capacitor electrode;

a first power line that determines a potential of the driver drain electrode;

a second power line electrically connected to the second luminescence electrode;

a data line that supplies a signal voltage to the first capacitor electrode;

a first switch that switchably interconnects the data line and the first capacitor electrode;

a bias voltage line that supplies, while the signal voltage is supplied to the first capacitor electrode, a predetermined bias voltage to the second capacitor electrode such that a capacitor potential difference between the first capacitor electrode and the second capacitor electrode is at most equal to a driver threshold voltage of the driver;

a second capacitor that interconnects the second capacitor electrode and the bias voltage line; and a controller that controls the first switch, a supply of the predetermined bias voltage from the bias voltage line, and a supply of the signal voltage from the data line, wherein the controller is configured to:

write the predetermined bias voltage to the second capacitor via the bias voltage line to supply the second capacitor electrode with the predetermined bias voltage such that the capacitor potential difference is at most equal to the driver threshold voltage, even when the signal voltage is supplied to the first capacitor electrode, to prevent a flow of the drain current between the driver source electrode and the second capacitor electrode;

supply the signal voltage to the first capacitor electrode when the flow of the drain current between the driver source electrode and the second capacitor electrode is prevented and the first switch is in an ON state;

write a reverse bias voltage corresponding to the predetermined bias voltage to the second capacitor via the bias voltage line to cause the flow of the drain current between the driver source electrode and the second capacitor electrode when the signal voltage is supplied to the first capacitor electrode; and turn OFF the first switch after an elapse of a predetermined period of time after causing the flow of the drain current between the driver source electrode and the second capacitor electrode to stop the supply of the signal voltage to the first capacitor electrode, whereby an electrical charge accumulated in the first capacitor is discharged during the predetermined period when the flow of the drain current between the driver source electrode and the second capacitor electrode is caused.

2. The display panel device according to claim 1, wherein, when the reverse bias voltage corresponding to the predetermined bias voltage is written to the second capacitor via the bias voltage line, a voltage is written to the second capacitor in accordance with a first gradual change from the predetermined bias voltage to the reverse bias voltage.

3. The display panel device according to claim 2, further comprising:

a scanning line that switchably interconnects the data line and the first capacitor electrode with the first switch by supplying a scanning signal voltage to a first switch gate electrode of the first switch, wherein, when the first switch is in an OFF state after the elapse of the predetermined period of time, the controller supplies the scanning signal voltage from the scanning line to the first switch, the scanning signal voltage being supplied in accordance with a second gradual change.

4. The display panel device according to claim 3, wherein a degree of the first gradual change from the predetermined bias voltage to the reverse bias voltage is equal to a degree of the second gradual change in the scanning signal voltage that is supplied to the first switch.

5. The display panel device according to claim 2, wherein the luminescence element further includes a luminescent layer sandwiched between the first luminescence electrode and the second luminescence electrode, at least the luminescence element, the first capacitor, the driver, and the second capacitor compose a pixel, the display device includes a plurality of pixels that includes the pixel, and the first gradual change from the predetermined bias voltage to the reverse bias voltage corresponds to a change in an amount of the reverse bias voltage written to the second capacitor, over a period of time from a writing start to a writing end, in one of the plurality of pixels that is located in an area of the display panel device that is farthest from the controller.

6. The display panel device according to claim 5, further comprising:

a scanning line that switchably interconnects the data line and the first capacitor electrode with the first switch by supplying a scanning signal voltage to a first switch gate electrode of the first switch, wherein a second gradual change in the scanning signal voltage supplied to the first switch gate electrode corresponds to a change in a voltage of the first switch gate electrode in the one the plurality of pixels that is located in the area of the display panel device that is farthest from the controller, the second gradual change being caused by the controller when the controller turns OFF the first switch after the elapse of the predetermined period of time.

7. The display panel device according to claim 1, further comprising:

a third power line that supplies a reference voltage to the second capacitor electrode; and a second switch that switchably interconnects the second capacitor electrode and the third power line, wherein the reference voltage causes the capacitor potential difference to be greater than the driver threshold voltage, and the controller is further configured to:

turn ON the second switch to supply the reference voltage to the second capacitor electrode;

turn ON the first switch to supply a fixed voltage to fix a voltage of the first capacitor electrode;

supply, after the potential difference in the first capacitor reaches the driver threshold voltage and the driver is in an OFF state, the predetermined bias voltage via the bias voltage line to prevent the flow of the drain current between the driver source electrode and the second capacitor electrode while the driver is in the OFF state; and turn ON the first switch when the flow of the drain current between the driver source electrode and the second capacitor electrode is prevented, and supply the signal voltage to the first capacitor electrode.

8. The display panel device according to claim 7, wherein a voltage value of the predetermined bias voltage is preset such that, after the capacitor potential difference reaches the driver threshold voltage and the driver is in the OFF state, a luminescence potential difference between the first luminescence electrode and the second luminescence electrode is less than a luminescence threshold voltage of the luminescence element, the luminescence element producing the luminescence at the luminescence threshold voltage.

9. The display panel device according to claim 8, wherein the third power line is a scanning line, and the scanning line is configured to switchably interconnect the data line and the first capacitor electrode with the first switch by supplying a scanning signal voltage to a first switch gate electrode of the first switch, and the reference voltage is a voltage of the scanning line that that turns OFF the first switch to disconnect the data line and the first capacitor electrode.

10. The display panel device according to claim 1, further comprising:

a second switch that switchably interconnects the first luminescence electrode and the driver source electrode, wherein the controller is configured to turn OFF the second switch to disconnect the first luminescence electrode and the driver source electrode during the predetermined period of time.

11. The display panel device according to claim 10, wherein, after the electrical charge accumulated in the first capacitor is discharged during the predetermined period of time, the controller is configured to turn ON the second switch to interconnect the first luminescence electrode and the driver source electrode to flow the drain current, corresponding to the capacitor potential difference, between the first power line and the second power line.

12. The display panel device according to claim 1, further comprising:

a second switch that switchably interconnects the first luminescence electrode and the driver source electrode, wherein, when the predetermined bias voltage is written to the second capacitor via the bias voltage line and the signal voltage is supplied to the first capacitor electrode, the controller is configured to turn OFF the second switch to disconnect the first luminescence electrode and the driver source electrode.

13. The display panel device according to claim 1, wherein the bias voltage line further supplies a second reverse bias voltage to the second capacitor to cause the capacitor potential difference to be greater than the driver threshold voltage, and the controller is further configured to:

write the second reverse bias voltage to the second capacitor while the first switch is in the ON state and supply a fixed voltage to the first capacitor to fix a voltage of the first capacitor to cause the capacitor potential difference to be greater than the driver threshold voltage to cause the flow of the drain current between the driver source electrode and the second capacitor electrode;

stop the flow of the drain current between the driver source electrode and the second capacitor electrode, after the capacitor potential difference reaches the driver threshold voltage to turn OFF the driver; and turn ON the first switch to supply the signal voltage to the first capacitor electrode when the flow of the drain current between the driver source electrode and the second capacitor electrode is prevented while the driver is in an OFF state.

14. The display panel device according to claim 13, further comprising:

a second switch that switchably interconnects the first luminescence electrode and the driver source electrode, wherein the controller is further configured to turn OFF the second switch to disconnect the first luminescence electrode and the driver source electrode during a period of time from when the second reverse bias voltage is supplied to the second capacitor to when the capacitor potential difference reaches the driver threshold voltage to turn OFF the driver.

15. A display device, comprising:

the display panel device according to claim 1; and a power source that supplies power to the first power line and the second power line, wherein the luminescence element further includes a luminescent layer sandwiched between the first luminescence electrode and the second luminescence electrode, and the luminescence element is included in a matrix in which at least a plurality of the luminescence element is are arranged.

16. The display device according to claim 15, wherein the luminescence element is an organic electroluminescence element.

17. A display device, comprising:

the display panel device according to claim 1; and a power source that supplies power to the first power line and the second power line, wherein the luminescence element further includes a luminescent layer sandwiched between the first luminescence electrode and the second luminescence electrode, the luminescence element, the first capacitor, the driver, the first switch, and the second switch compose a pixel, and the pixel is included in a matrix in which a plurality of pixels that included the pixel is arranged.

18. A method of controlling a display device, wherein the display device includes:

a luminescence element including a first luminescence electrode and a second luminescence electrode;

a first capacitor including a first capacitor electrode and a second capacitor electrode that holds a capacitor voltage;

a driver including a driver gate electrode, a driver drain electrode, and a driver source electrode that drives the luminescence element to produce a luminescence by flowing a drain current corresponding to the capacitor voltage through the luminescence element, the driver gate electrode connected to the first capacitor electrode, the driver source electrode connected to the second capacitor electrode;

a first power line that determines a potential of the driver drain electrode;

a second power line electrically connected to the second luminescence electrode;

a data line that supplies a signal voltage to the first capacitor electrode;

a first switch that switchably interconnects the data line and the first capacitor electrode;

a bias voltage line that supplies, while the signal voltage is supplied to the first capacitor electrode, a predetermined bias voltage to the second capacitor electrode such that a capacitor potential difference between the first capacitor electrode and the second capacitor electrode is at most equal to a driver threshold voltage of the driver; and a second capacitor that interconnects the second capacitor electrode and the bias voltage line, and the control method comprising:

writing the predetermined bias voltage to the second capacitor via the bias voltage line to supply the second capacitor electrode with the voltage such that the capacitor potential difference is at most equal to the driver threshold voltage, even when the signal voltage is supplied to the first capacitor electrode, to prevent a flow of the drain current between the driver source electrode and the second capacitor electrode;

supplying the signal voltage to the first capacitor electrode when the flow of the drain current between the driver source electrode and the second capacitor electrode is prevented and when the first switch is in an ON state;

writing a reverse bias voltage corresponding to the predetermined bias voltage to the second capacitor via the bias voltage line to cause the flow of the drain current between the driver source electrode and the second capacitor electrode when the signal voltage is supplied to the first capacitor electrode; and turning OFF the first switch after an elapse of a predetermined period of time after causing the flow of the drain current between the driver source electrode and the second capacitor electrode to stop the supply of the signal voltage to the first capacitor electrode, whereby an electrical charge accumulated in the first capacitor is discharged during the predetermined period when the flow of the drain current between the driver source electrode and the second capacitor electrode is caused.

* * * * *

UNITED STATES PATENT AND TRADEMARK OFFICE

CERTIFICATE OF CORRECTION

PATENT NO. : 8,243,107 B2
APPLICATION NO. : 13/035170
DATED : August 14, 2012
INVENTOR(S) : M. Matsui et al.

It is certified that error appears in the above-identified patent and that said Letters Patent is hereby corrected as shown below:

At column 45, lines 57 and 58 (Claim 9, lines 7 and 8) "that that turns OFF" should be --that turns OFF--.

At column 46, lines 63 and 64 (Claim 15, lines 10 and 11) "element is are arranged." should be --element is arranged.--.

Signed and Sealed this
Sixth Day of November, 2012

David J. Kappos

David J. Kappos
*Director of the United States Patent and Trademark Office*